US007173595B2

(12) United States Patent
Tanaka et al.

(10) Patent No.: US 7,173,595 B2
(45) **Date of Patent: *Feb. 6, 2007**

(54) DISPLAY DEVICE AND DRIVING METHOD THEREOF

(75) Inventors: Masahiro Tanaka, Yotsukaido (JP); Nobuhiro Takeda, Mobara (JP)

(73) Assignee: Hitachi Displays, Ltd., Mobara (JP)

( * ) Notice: Subject to any disclaimer, the term of this patent is extended or adjusted under 35 U.S.C. 154(b) by 342 days.

This patent is subject to a terminal disclaimer.

(21) Appl. No.: 10/787,295

(22) Filed: Feb. 27, 2004

(65) Prior Publication Data

US 2004/0169631 A1 Sep. 2, 2004

(30) Foreign Application Priority Data

Feb. 28, 2003 (JP) ..... 2003-053731

(51) Int. Cl.
*G09G 3/36* (2006.01)
*G09G 5/00* (2006.01)

(52) U.S. Cl. ..... 345/98; 345/96; 345/100; 345/209

(58) Field of Classification Search ..... 345/87–102, 345/204–212; 315/169.1–169.4
See application file for complete search history.

(56) References Cited

U.S. PATENT DOCUMENTS 5,510,805 A * 4/1996 Lee ..... 345/58
5,648,790 A * 7/1997 Lee ..... 345/58
6,448,718 B1 * 9/2002 Battersby ..... 315/169.3
6,882,103 B2 * 4/2005 Kim et al. ..... 313/504

* cited by examiner

*Primary Examiner*—Vijay Shankar
(74) *Attorney, Agent, or Firm*—Antonelli, Terry, Stout and Kraus, LLP.

(57) ABSTRACT

In a display device the possibility that the ratio between a display period for display signals and a display period for blanking signals differs from a preset ratio is eliminated, even when the video data is changed. A display device sequentially supplies blanking data from a data driver circuit which sequentially supplies display signals after a lapse of a given time from starting the supply of the display signals. In the display device, a ratio of display is set based on the blanking data per one frame period. Further, the number of pulses of a horizontal synchronizing signal is measured in one frame period contained in the video data, and a point of time is determined for starting display based on the blanking data in response to pulses of the horizontal synchronizing signal corresponding to the ratio based on a measured value of the number of pulses.

8 Claims, 10 Drawing Sheets

DISPLAY DEVICE AND DRIVING METHOD THEREOF

BACKGROUND OF THE INVENTION

The present invention relates to a display device such as an active-matrix type liquid crystal display device or an electroluminescence array or the like, for example.

An active matrix type display device is, for example, configured such that the display device includes a pixel array which is formed by arranging a plurality of pixel rows, each of which includes a plurality of pixels aligned in the x direction, in parallel in the y direction, a scanning drive circuit which selects the plurality of respective pixel rows in response to scanning signals, and a data driver circuit which supplies display signals to the respective pixels included in at least one pixel row selected in response to a scanning signal.

In such a constitution, to make animated images more vivid at the time of displaying the animated images, there have been several attempts to produce a black display of the whole region of a screen over a plurality of frames by sequentially supplying so-called blanking data after a lapse of a given time from the start of supply of display signals from the data driver circuit which sequentially supplies the display signals.

In this case, the progress of writing of the display signals to the pixel array and the progress of writing of the blanking data substantially take place in substantially the same manner with respect to the lapse of time. Accordingly, by setting the time from the start of supply of the display signal to the start of supply of the blanking data, a ratio between the display period for the display signals and the display period for the blanking data can be arbitrarily set.

However, in the above-mentioned display device, the time from the start of supply of the display signal to the start of supply of the blanking data is made to correspond to the number of pulses of horizontal synchronizing signals included in the image data inputted to the display device; and, hence, after setting the ratio between the display period for the display signals and the display period for the blanking data, when the image data is changed to image data from a television receiver set, for example, the cycle of the horizontal synchronizing signals is changed.

Accordingly, there arises a drawback in that the ratio between the display period for the display signals and the display period for the blanking data becomes different from the preset ratio.

SUMMARY OF THE INVENTION

The present invention has been made under such circumstances and it is an object of the present invention to provide a display device which can prevent a ratio between a display period for display signals and a display period for blanking data from being changed from a preset ratio even when the video data are changed.

A summary of representative features and aspects of the invention disclosed in this specification will be set forth as follows.

EXAMPLE 1

A display device according to the present invention comprises, for example, a pixel array in which a plurality of pixel rows, each of which includes a plurality of pixels aligned along a first direction, are arranged in parallel along a second direction which intersects the first direction, a scanning driver circuit which selects the respective pixel rows in response to a scanning signal, a data driver circuit which supplies a display signal to the respective pixels included in at least one row selected in response to a scanning signal, and a display control circuit which controls a display operation of the pixel array, wherein lines of image data are inputted to the data driver circuit one after another for every horizontal scanning period of the image data, the data driver circuit alternately repeats (i) a first step of generating a display signal corresponding to each one of the lines of the image data, one after another, for every fixed period and of outputting the display signal to the pixel array N-times (N being a natural number equal to or greater than 2) and (ii) a second step of generating a display signal which makes the luminance of the pixels lower than the luminance of the pixel in the first step for the fixed period and of outputting the display signal to the pixel array M-times (M being a natural number smaller than N), the scanning driver circuit alternately repeats (i) a first selection step of selecting the plurality of pixel rows for every Y rows (Y being a natural number smaller than the N/M) sequentially from one end to another end of the pixel array along the second direction in the first step and (ii) a second selection step of selecting the plurality of pixel rows other than the pixel rows (Y×N) selected in the first selection step for every Z rows (Z being a natural number not smaller than N/M) sequentially from one end to another end of the pixel array along the second direction in the second step, and the display device further includes means which sets a ratio of display in the second step per one frame period, and means which measures the number of pulses of a horizontal synchronizing signal in one frame period contained in the image data, and determines a point of time for starting display in the second step in response to pulses of the horizontal synchronizing signal corresponding to the ratio based on a measured value of the number of pulses.

EXAMPLE 2

A display device according to the present invention comprises, for example, a pixel array in which a plurality of pixel rows, each of which includes a plurality of pixels aligned along a first direction, are arranged in parallel along a second direction which intersects the first direction, a scanning driver circuit which selects the respective pixel rows in response to a scanning signal, a data driver circuit which supplies a display signal to the respective pixels included in at least one row selected in response to the scanning signal, and a display control circuit which controls a display operation of the pixel array, wherein lines of data are inputted to the data driver circuit one after another for every horizontal scanning period of the data, the data driver circuit alternately repeats (i) a first step of generating a display signal corresponding to each one of the lines of data one after another for every fixed period and of outputting the display signal to the pixel array N-times (N being a natural number equal to or greater than 2) and (ii) a second step of generating a display signal which makes the luminance of the pixels lower than the luminance of the pixel in the first step for the fixed period and of outputting the display signal to the pixel array M-times (M being a natural number smaller than N), the scanning driver circuit alternately repeats (i) a first selection step of selecting the plurality of pixel rows for every Y rows (Y being a natural number smaller than the N/M) sequentially from one end to another end of the pixel array along the second direction in the first step and (ii) a second selection step of selecting the plurality of pixel rows other than the pixel rows (Y×N) selected in the first selection step for every Z rows (Z being a natural number not smaller than N/M) sequentially from one end to another end of the pixel array along the second direction in the second step, and the display device further includes means which sets a ratio of display in the first step per one frame period, and means which measures the number of pulses of a horizontal synchronizing signal in one frame period contained in the video data, and determines a point of time for starting display in the second step in response to pulses of the horizontal synchronizing signal corresponding to the ratio based on a measured value of the number of pulses.

EXAMPLE 3

The display device according to the present invention is, for example, on the premise of the constitution of the Example 1 or 2, characterized in that the number of rows: Y of the pixel rows which are selected in the first selection step in response to a single output of the display signal in the first step is 1, the number of outputs: N of the display signal in the first step is 4 or more, the number of rows: Z of the pixel rows which are selected in the second selection step in response to a single output of the display signal in the second step is 4 or more, and the number of outputs: M of the display signal in the second step is 1.

EXAMPLE 4

A display device according to the present invention comprises, for example, a pixel array in which a plurality of pixel rows, each of which includes a plurality of pixels aligned along a first direction, are arranged in parallel along a second direction which intersects the first direction, a scanning driver circuit which selects the respective pixel rows in response to a scanning signal, a data driver circuit which supplies a display signal to the respective pixels included in at least one row selected in response to the scanning signal, and a display control circuit which controls a display operation of the pixel array and is configured such that the pixel array is divided by an imaginary line which extends along the first direction as a boundary, and respective divided arrays are independently operated in response to the scanning drive circuit and the data driver circuit, wherein lines of video data are inputted to the data driver circuit one after another for every horizontal scanning period of the video data, the data driver circuit alternately repeats (i) a first step of generating a display signal corresponding to each one of the lines of the video data one after another for every fixed period and of outputting the display signal to one pixel array at least a single time and (ii) a second step of generating a display signal which makes the luminance of the pixels lower than the luminance of the pixel in the first step for the fixed period and of outputting the display signal to another pixel array at least a single time, the scanning driver circuit alternately repeats (i) a first selection step of selecting the plurality of pixel rows for at least every 1 line sequentially from one end to another end of one pixel array along the second direction in the first step and (ii) a second selection step of selecting the plurality of pixel rows for at least every 1 line sequentially from one end to another end of another pixel array along the second direction in the second step, and the display device further includes means which sets a ratio of display in the second step per one frame period, and means which measures the number of pulses of a horizontal synchronizing signal in one frame period contained in the data and determines a point of time for starting display in the second step in response to pulses of the horizontal synchronizing signal corresponding to the ratio based on a measured value of the number of pulses.

EXAMPLE 5

A display device according to the present invention comprises, for example, a pixel array in which a plurality of pixel rows, each of which includes a plurality of pixels aligned along a first direction, are arranged in parallel along a second direction which intersects the first direction, a scanning driver circuit which selects the respective pixel rows in response to a scanning signal, a data driver circuit which supplies a display signal to the respective pixels included in at least one row selected in response to the scanning signal, and a display control circuit which controls a display operation of the pixel array and is configured such that the pixel array is divided by an imaginary line which extends along the first direction as a boundary, and respective divided arrays are independently operated in response to the scanning drive circuit and the data driver circuit, wherein lines of data are inputted to the data driver circuit one after another for every horizontal scanning period of the data, the data driver circuit alternately repeats (i) a first step of generating a display signal corresponding to each one of the lines of the data one after another for every fixed period and of outputting the display signal to one pixel array at least a single time and (ii) a second step of generating a display signal which makes the luminance of the pixels lower than the luminance of the pixel in the first step for the fixed period and of outputting the display signal to another pixel array at least a single time, the scanning driver circuit alternately repeats (i) a first selection step of selecting the plurality of pixel rows for at least every 1 line sequentially from one end to another end of one pixel array along the second direction in the first step and (ii) a second selection step of selecting the plurality of pixel rows for at least every 1 line sequentially from one end to another end of another pixel array along the second direction in the second step, and the display device further includes means which sets a ratio of display in the first step per one frame period, and means which measures the number of pulses of a horizontal synchronizing signal in one frame period contained in the data, and determines a point of time for starting display in the second step in response to pulses of the horizontal synchronizing signal corresponding to the ratio based on a measured value of the number of pulses.

EXAMPLE 6

The display device according to the present invention is, for example, on the premise of the constitution of any one of Examples 1, 2, 4 or 5, characterized in that means which measures the number of pulses of horizontal synchronizing signals for one frame period contained in the image data and determines a point of time for starting display in the second step in response to pulses of the horizontal synchronizing signals corresponding to the ratio based on the measured value is incorporated into the display control circuit.

Here, the present invention is not limited to the above-mentioned constitutions and various modifications are conceivable without departing from the technical concept of the present invention.

DESCRIPTION OF THE PREFERRED EMBODIMENTS

Preferred embodiments of a liquid crystal display device according to the present invention will be explained in conjunction with the drawings.

First Embodiment

A display device and a method of driving the same according to a first embodiment of the present invention will be explained in conjunction with FIG. 1 to FIG. 7. In this embodiment, the explanation is directed to a display device (liquid crystal display device) which uses an active matrix-type liquid crystal display panel as a pixel array. However, the basic structure and driving method of the display device are also applicable to a display device which uses an electroluminescence array or a light emitting diode array as a pixel array.

Figure 1:
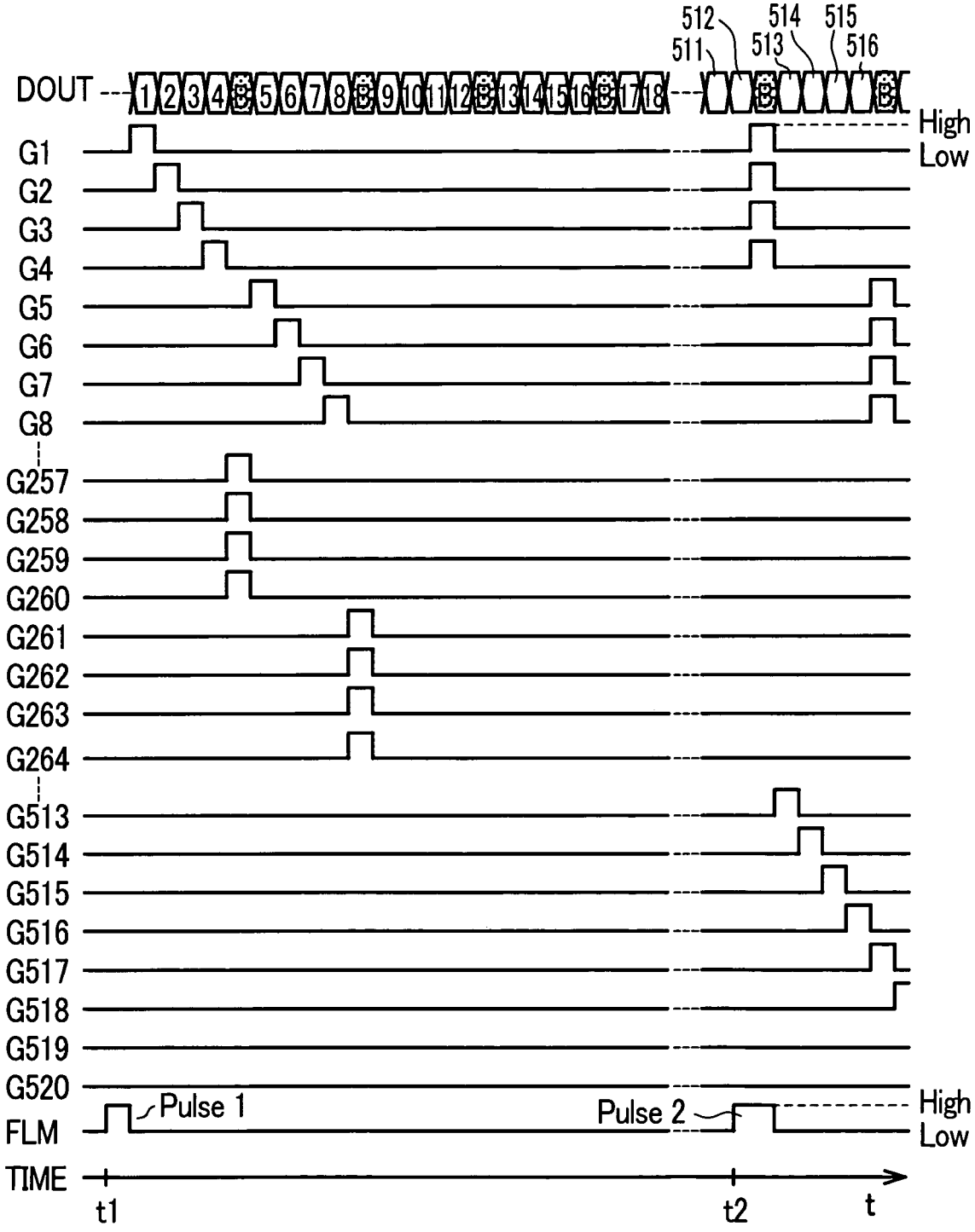
FIG. 1 is a diagram which shows output timing of display signals and driving waveforms of scanning lines which correspond to the output timing in a first embodiment of a driving method of a liquid crystal display device according to the present invention.
Figure 2:
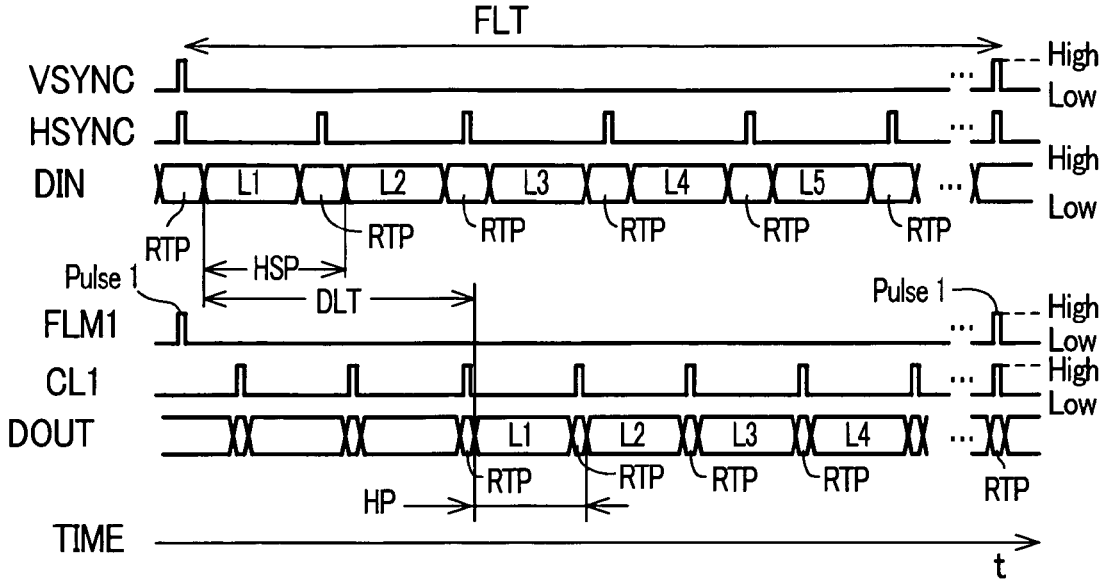
FIG. 2 is a diagram showing timing of input waveforms (input data) of image data to a display control circuit (timing controller) and output waveforms (driver data) from the display control circuit in the first embodiment of a driving method of a liquid crystal display device according to the present invention.
Figure 3:
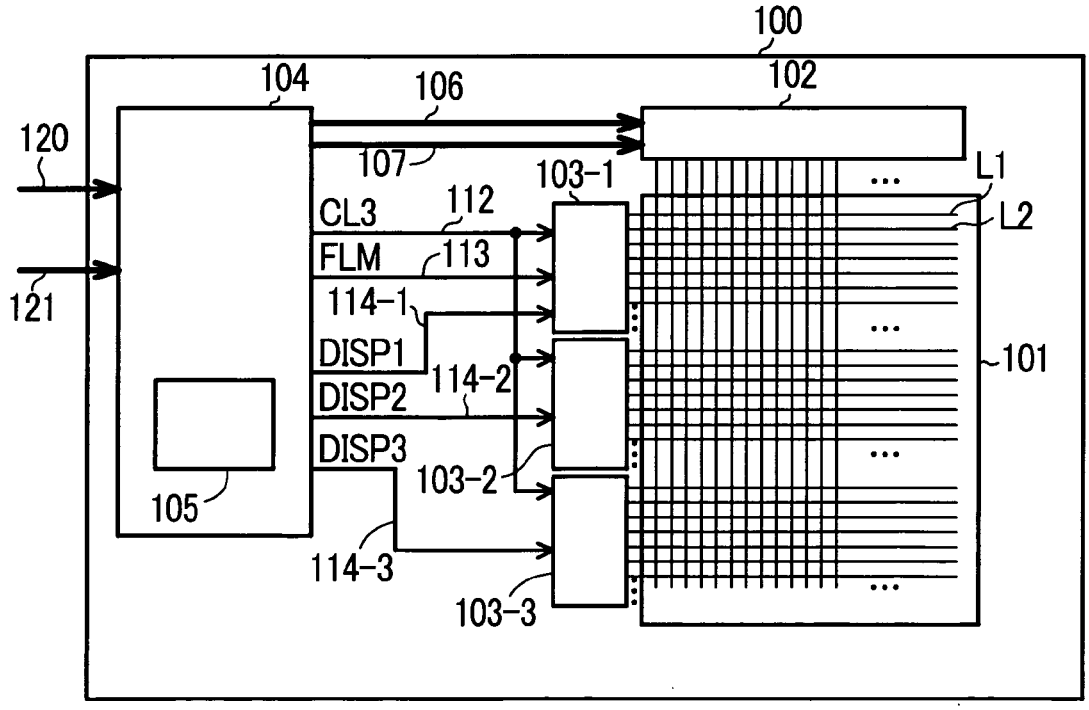
FIG. 3 is a block diagram showing the overall configuration of the liquid crystal display device according to the present invention.
Figure 4:
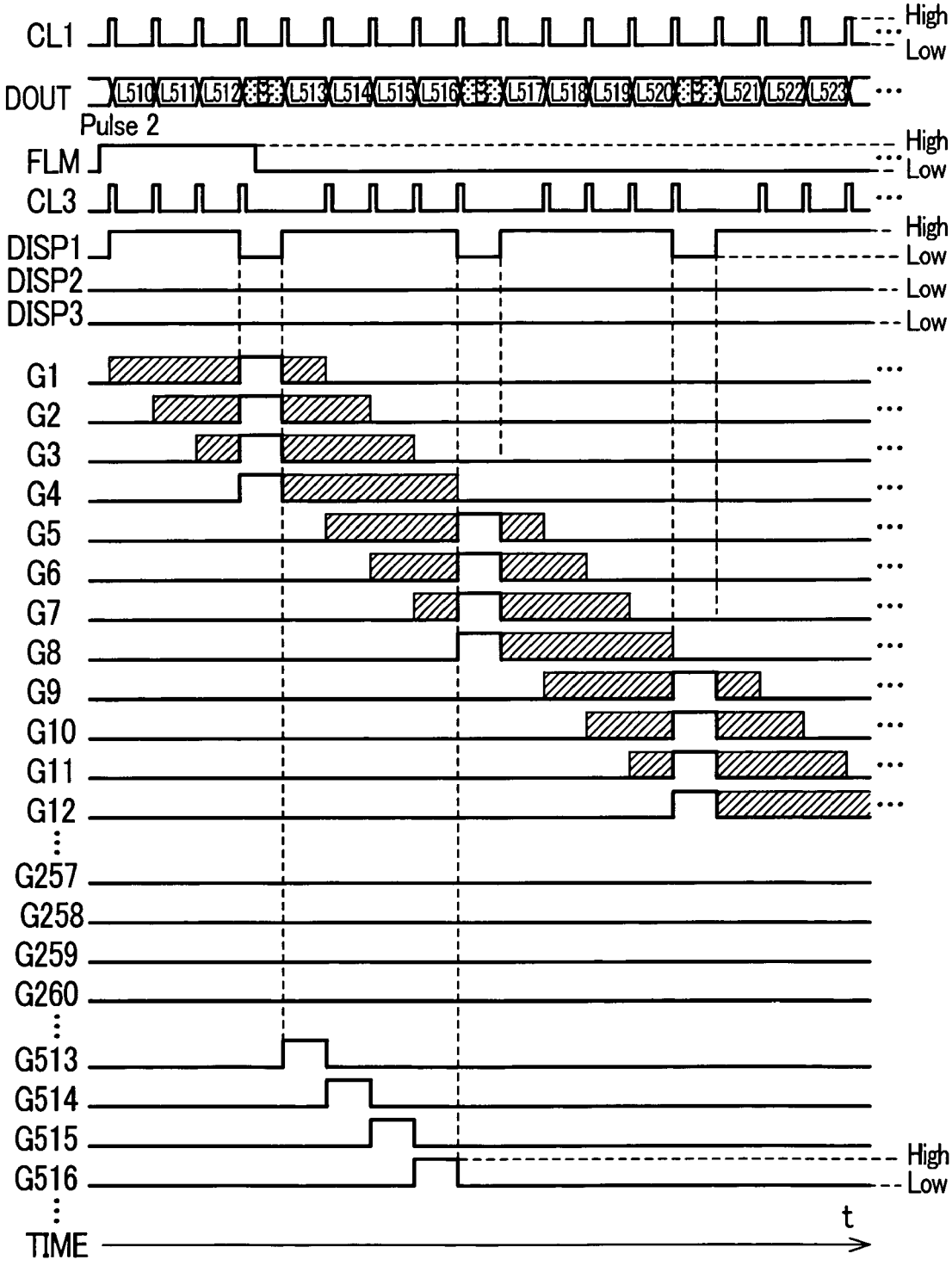
FIG. 4 is a diagram showing driving waveforms which select four scanning lines simultaneously during an output period of display signals in the first embodiment of a driving method of a liquid crystal display device according to the present invention.
Figure 5:
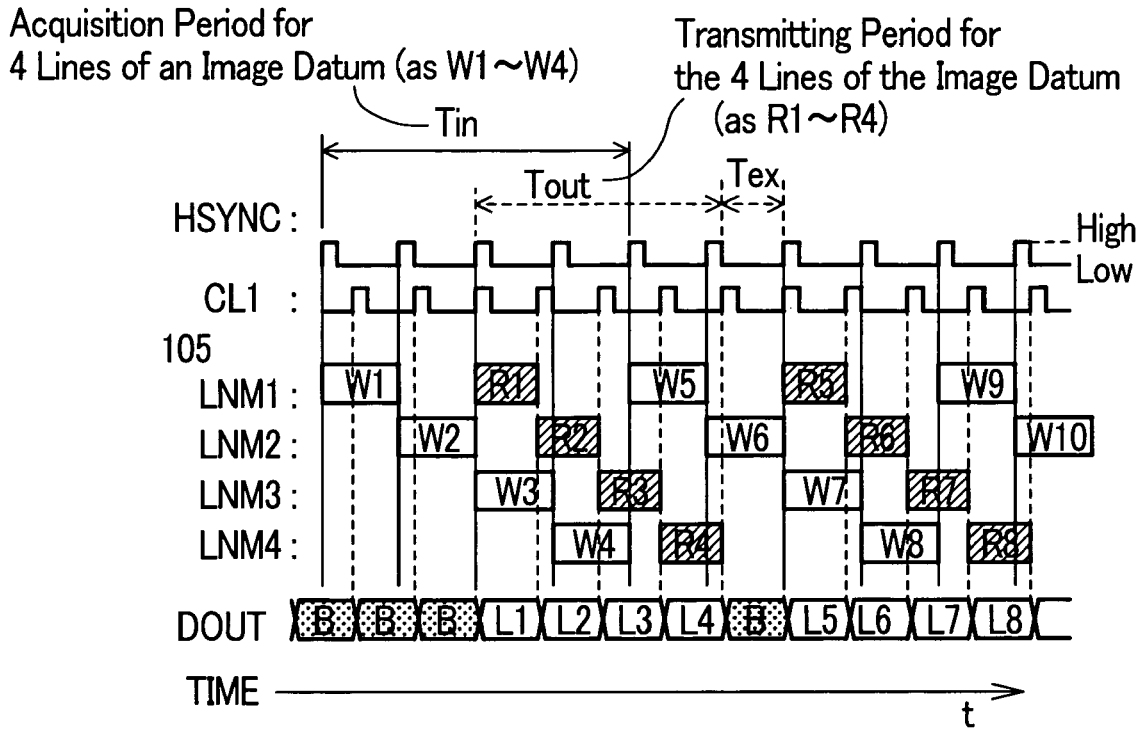
FIG. 5 is a diagram showing respective timings for writing image data to a plurality of (for example, four) line memories provided to a liquid crystal display device according to the present invention and for reading out the image data from the line memories.
Figure 6:
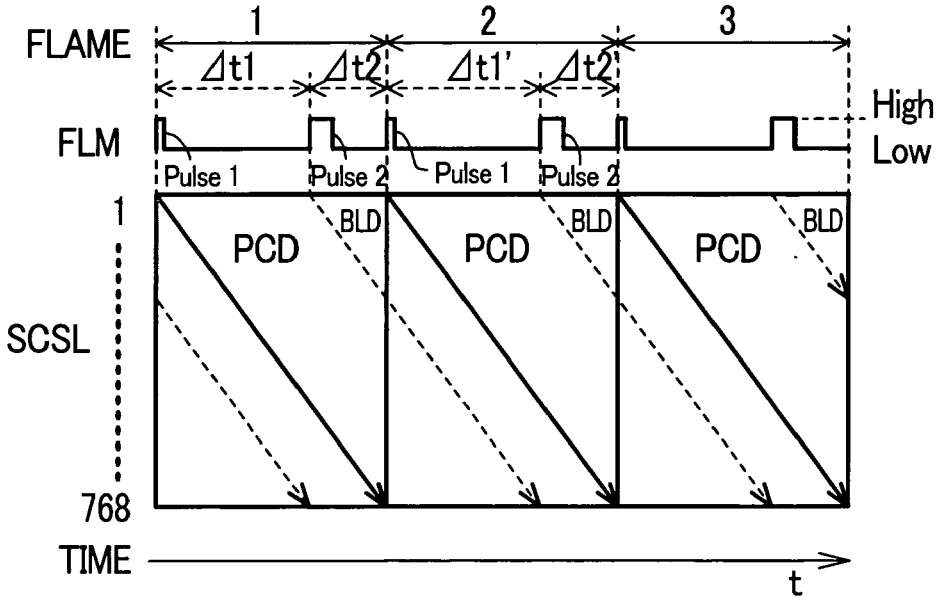
FIG. 6 is a diagram showing pixel display timing of every frame period (each one of three continuous frame periods) in the first embodiment of the driving method of the liquid crystal display device according to the present invention.
Figure 7:
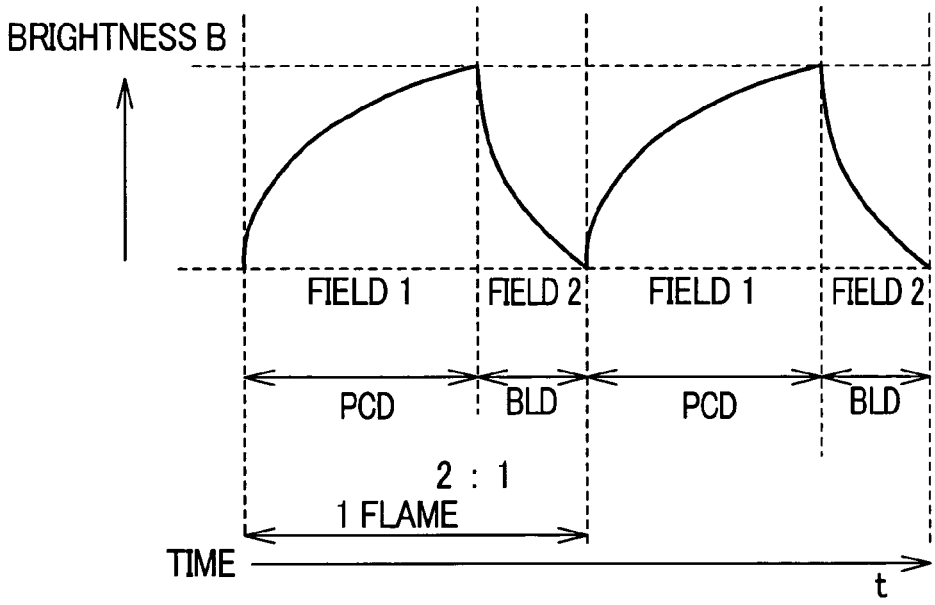
FIG. 7 is a diagram showing the luminance response to display signals (change of optical transmissivity of a liquid crystal layer corresponding to pixels) when the liquid crystal display device of the present invention is driven in accordance with the pixel display timing shown in FIG. 6.
Figure 9:
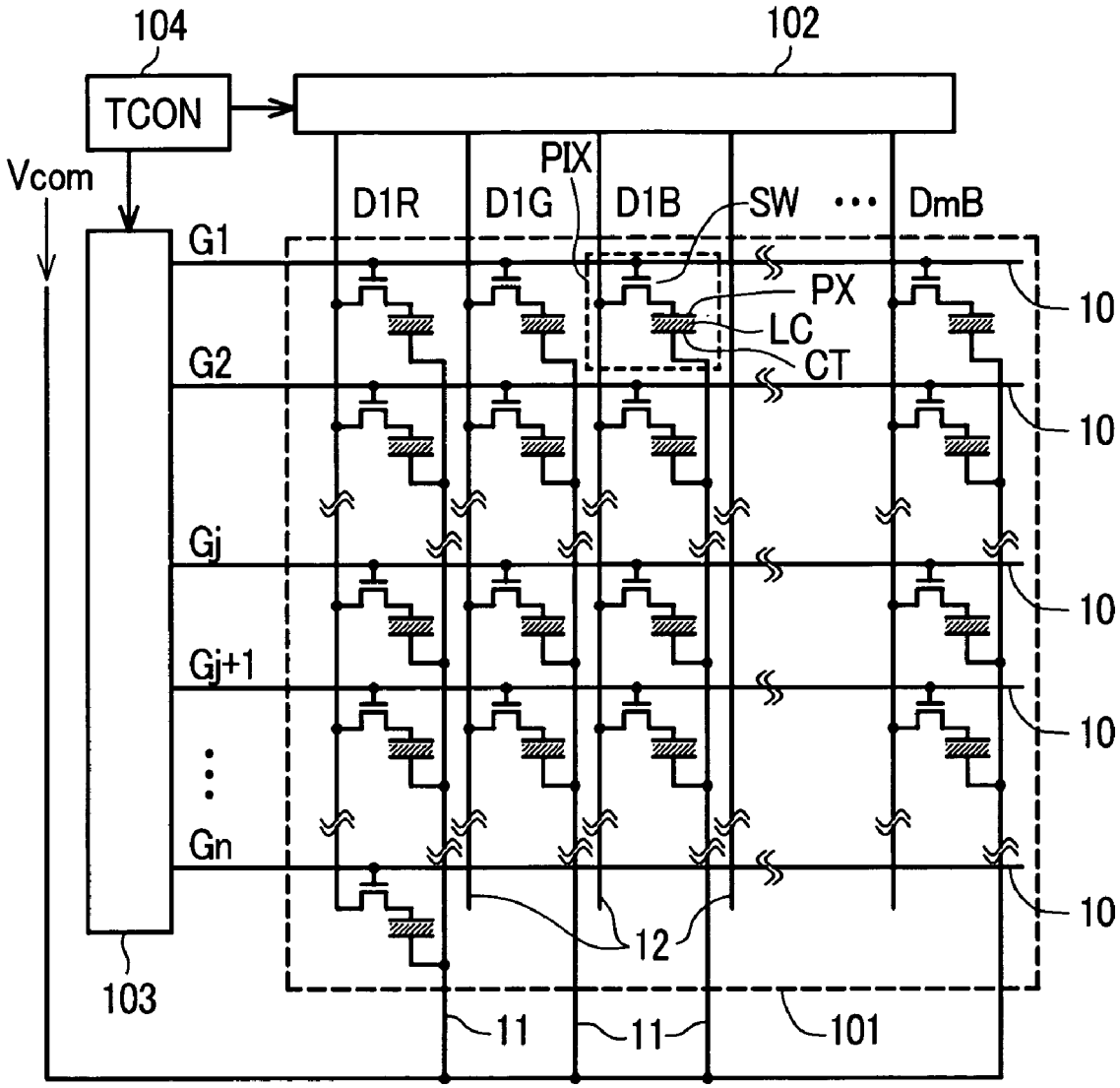
FIG. 9 is a schematic diagram showing one example of a pixel array provided to an active matrix type display device.

FIG. 1 is a timing chart showing the selection timing of display signal outputs (data driver output voltages) DOUT to the pixel array of the display device according to the present invention and scanning signal lines G1 in the inside of the pixel array corresponding to the respective signal outputs. FIG. 2 is a timing chart showing timing of the inputting (input data) DIN of image data to a display control circuit (timing controller) provided to the display device and the timing of outputting of image data (driver data) from the display control circuit. FIG. 3 is a block diagram showing the overall configuration of the display device of the embodiment of the present invention, wherein one example of the details of a pixel array 101 shown in FIG. 3 and a periphery thereof is shown in FIG. 9. The previously-mentioned timing charts shown in FIG. 1 and FIG. 2 are depicted based on the constitution of the display device (liquid crystal display device) shown in FIG. 3. FIG. 4 is a timing chart showing another example of the timing for each selection of display signal outputs (data driver output voltages) to the pixel array of the display device according to this embodiment and scanning signal lines corresponding to respective outputs. Out of scanning signal lines to which scanning signals are outputted from a shift-register type scanning driver during an outputting period of the display signals, four scanning signal lines are selected and display signals are supplied to pixel rows which respectively correspond to these scanning signal lines. FIG. 5 is a timing chart showing timing in which image data for four lines are written one after another to every other four line memories included in a line-memory circuit 105 provided to a display control circuit 104 (see FIG. 3), and the image data is read out from respective line memories and transferred to a data driver (video signal driver circuit). FIG. 6 relates to a method of driving the display device of the present invention and shows display timing of image data and blanking data according to this embodiment in the pixel array, while FIG. 7 shows the luminance response (change of optical transmissivity of liquid crystal layer corresponding to pixels) of pixels when the display device (liquid crystal display device) of this embodiment is driven in accordance with this timing.

Firstly, a general description of the display device 100 of this embodiment will be explained in conjunction with FIG. 3.

The display device 100 includes a liquid crystal display panel (hereinafter referred to as "liquid crystal panel") having a resolution of the WXGA class as a pixel array 101. The pixel array 101 having a resolution of the WXGA class is not limited to a liquid crystal panel and is characterized in that 768 pixel rows, each of which gas pixels of 1280 dots arranged in the horizontal direction, are juxtaposed in the vertical direction in the screen.

Although the pixel array 101 of the display device of this embodiment is substantially the same as the pixel array of the display device explained in conjunction with FIG. 9, due to the resolution thereof, the gate lines 10 consisting of 768 lines and the data lines 12 consisting of 1280 lines are respectively juxtaposed within the screen of the pixel array 101. Further, in the pixel array 101, 983040 pixels PIX, each of which is selected in response to a scanning signal transmitted through one of the former lines and which receives the display signal from one of the latter lines, are arranged two-dimensionally, and images are produced by these pixels PIX.

When the pixel array displays color images, each pixel is divided in the horizontal direction corresponding to the number of primary colors used in the color display. For example, in a liquid crystal panel having a color filter corresponding to three primary colors (red, green, blue) of light, the number of the above-mentioned data lines 12 is increased to 3840 lines and the total number of pixels PIX included in the display screen is also three times as large as the above-mentioned value.

To describe the above-mentioned liquid crystal panel used as the pixel array 101 in this embodiment in more detail, each pixel PIX included in the liquid crystal panel is provided with a thin film transistor (abbreviated as TFT) which serves as the switching element SW. Further, each pixel is operated in a so-called normally black-displaying mode in which the larger the display signal supplied to each pixel, the higher will be the luminance exhibited by a pixel. Not only the pixel of the liquid crystal panel of this embodiment, but also a pixel of the above-mentioned electroluminescence array or light emitting diode array can be operated in the normally black-displaying mode.

In a liquid crystal panel operated in the normally black-displaying mode, the greater the potential difference between a gray scale voltage applied to the pixel electrode PX formed in the pixel PIX in FIG. 9 from the data line 12 through the switching element SW and a counter voltage (also referred to as reference voltage, common voltage) applied to the counter electrode CT, which faces the pixel electrode PX while sandwiching a liquid crystal layer LC therebetween, the higher the optical transmissivity of the liquid crystal layer LC will be elevated so as to increase the luminance of the pixel PIX. That is, with respect to the gray scale voltage which is the display signal of the liquid crystal panel, the remoter the value of the gray scale voltage from the value of the counter voltage, the more the display signal is increased.

To the pixel array (TFT-type liquid crystal panel) 101 shown in FIG. 3, in the same manner as the pixel array 101 shown in FIG. 9, a data driver (display signal driver circuit) 102 which supplies display signals (gray scale voltages or tone voltages) corresponding to the display data to the data lines (signal lines) 12 formed on the pixel array 101 and scanning drivers (scanning signal driver circuits) 103-1, 103-2, 103-3 which supply scanning signals (voltage signals) to the gate lines (scanning lines) 10 formed on the pixel array 101 are respectively provided. In this embodiment, although the scanning driver is divided into three drivers along the so-called vertical direction of the pixel array 101, the number of these drivers is not limited to three. Further, these drivers may be replaced with one scanning driver which combines these functions. On the other hand, the data driver may be divided into several components.

A display control circuit (timing controller) 104 transmits the above-mentioned display data (driver data) 106 and timing signals (data driver control signals) 107 for controlling display signal outputs corresponding to the display data 106 to the data driver 102. Further, the display control circuit 104 transmits scanning clock signals 112 and scanning start signals 113 to the respective scanning drivers 103-1, 103-2, 103-3. Although the display control circuit 104 also transfers scanning state selecting signals 114-1, 114-2, 114-3 corresponding to the scanning drivers 103-1, 103-2, 103-3 to these scanning drivers 103-1, 103-2, 103-3, this function will be explained later. The scanning state selecting signals are also referred to as display-operation selecting signals in view of the function thereof.

The display control circuit 104 receives image data (video signals) 120 and video control signals 121 inputted to the display control circuit 104 from an external video signal source of the display device 100, such as a television receiver set, a personal computer, a DVD player or the like. Although a memory circuit 105, which temporarily stores the image data 120, is provided inside of or at the periphery of the display control circuit 104, in this embodiment, a line memory circuit 105 is incorporated in the display control circuit 104. The video control signals 121 include a vertical synchronizing signal VSYNC which controls the transmission state of the image data, a horizontal synchronizing signal HSYNC, a dot clock signal DOTCLK and a display timing signal DTMG. The image data which generates an image for one screen in the display device 100 is inputted to the display control circuit 104 in response to (in synchronism with) the vertical synchronizing signal VSYNC. That is, the image data is sequentially inputted to the display device 100 (display control circuit 104) from the above-mentioned video signal source for every cycle (also referred to as a vertical scanning period or frame period) defined by the vertical synchronizing signal VSYNC, and the image for one screen is displayed on the pixel array 101 successively for every frame period. The image data in one frame period is sequentially inputted to the display device by dividing a plurality of line data included in the image data with a cycle (also referred to as horizontal scanning period) defined by the above-mentioned horizontal synchronizing signals HSYNC. That is, each image data which is inputted to the display device for every frame period includes a plurality of line data and the image of one screen generated by the line data is generated by sequentially arranging images in the horizontal direction depending on every line data for every horizontal scanning period in the vertical direction. Data corresponding to respective pixels arranged in the horizontal direction in one screen are identified with cycles in which the above-mentioned respective line data are defined by the above-mentioned dot clock signals.

Since the image data 120 and video control signals 121 are also inputted to the type of display device which uses a cathode ray tube, it is necessary to ensure time for sweeping the electron lines thereof from the scanning completion position to the scanning start position for every horizontal scanning period and every frame period. This time constitutes a dead time in the transfer of the image information, and, hence, regions which are referred to as retrace periods RTP which do not contribute to the transfer of image information corresponding to the dead time are also provided to the image data 120. In the image data 120, the regions which correspond to these retrace periods are discriminated from other regions which contribute to the transfer of image information due to the above-mentioned display timing signal DTMG.

On the other hand, the active matrix type display device 100 according to this embodiment generates display signals corresponding to an amount of image data for one line (the above-mentioned line data) at the data driver 102 and these display signals are collectively outputted to a plurality of data lines (signal lines) 12 which are arranged in parallel in the pixel array 101 in response to the selection of the gate lines 10 by the scanning driver 103. Accordingly, theoretically, inputting of the line data to the pixel rows is continued from one horizontal scanning period to the next horizontal scanning period without sandwiching the retrace period therebetween, while inputting of the image data to the pixel array is also continued from one frame period to the next frame period. Accordingly, in the display device 100 of this embodiment, reading out of every image data (line data) for one line from the memory circuit (line memory) 105 using the display control circuit 104 is performed in accordance with the cycle generated by shortening the retrace periods which are included in the above-mentioned horizontal scanning periods HSP (allocated to storing of the image data for one line to the memory circuit 105). Since this cycle is reflected on an output interval of the display signals to the pixel array 101 to be described later, the cycle is referred to as the horizontal period of the pixel array operation or simply as the horizontal period HP. The display control circuit 104 generates a horizontal clock CL1 which defines the horizontal period and transfers the horizontal clock CL1 as one of the above-mentioned data driver control signals 107 to the data driver 102. In this embodiment, with respect to the time for storing the image data for one line to the memory circuit 105 (the above-mentioned horizontal scanning period), by shortening the time for reading out the image data from the memory circuit 105 (the above-mentioned horizontal period), the time for inputting blanking signals to the pixel array 101 for every 1 frame period is produced.

FIG. 2 is a timing chart showing one example of the inputting (storing) of image data to the memory circuit 105 and the outputting (reading-out) of the image data from the memory circuit 105 using the display control circuit 104. The image data which is inputted to the display device for every frame period defined by the pulse interval of the vertical synchronizing signal VSYNC is, as shown by the waveforms of the input data DIN, sequentially inputted to the memory circuit 105 using the display control circuit 104 in response to (in synchronism with) the horizontal synchronizing signal HSYNC, including respective retrace periods for every plurality of line data (image data of 1 line) L1, L2, L3, . . . included in the image data. The display control circuit 104 sequentially reads out the line data L1, L2, L3, . . . stored in the memory circuit 105 in accordance with the above-mentioned horizontal clock CL1 or the timing signals similar to the horizontal clock CL1, as shown by the waveforms of the output data. Here, the retrace periods TR, which cause respective line data L1, L2, L3, . . . outputted from the memory circuit 105 to be spaced apart from each other along a time axis TIME, are made shorter than the retrace periods TR which cause respective line data L1, L2, L3 . . . inputted to the memory circuit 105 to be spaced apart from each other along the time axis TIME. Accordingly, between the period necessary for inputting the line data to the memory circuit 105 N times (N being a natural number of 2 or more) and the period necessary for outputting the line data from the memory circuit 105 (N-time line data outputting period), a time which is capable of outputting the line data M times (M being a natural number smaller than N) from the memory circuit 105 is produced. In this embodiment, by making use of a so-called extra time in which the image data for M lines is outputted from the memory circuit 105, the pixel array 101 is made to perform a separate display operation.

Here, the image data (line data included in the image data in FIG. 2) is temporarily stored in the memory circuit 105 before being transferred to the data driver 102, and, hence, the image data is read out by the display control circuit 104 during a delay time DLT corresponding to the stored period. When a frame memory is used as the memory circuit 105, this delay time corresponds to one frame period. When the image data is inputted to the display device at the frequency of 30 Hz, one frame period thereof is about 33 ms (milliseconds), and, hence, a user of the display device cannot perceive the delay of display time of the image with respect to an input time of the image data to the display device. However, by providing a plurality of line memories to the display device 100 in place of the frame memory, as the above-mentioned memory circuit 105, this delay time can be shortened, the structure of the display control circuit 104 or the peripheral circuit structure can be simplified or an increase in the size can be suppressed.

One example of the driving method of the display device 100 using a line memory for storing a plurality of line data as the memory circuit 105 will be explained in conjunction with FIG. 5. In the driving of the display device 100 according to this example, in the above-mentioned extra time between the period for inputting image data for N lines to the display control circuit 104 and the period for outputting image data for N lines from the display control circuit 104 (period for sequentially outputting the display signals respectively corresponding to the N-line image data from the data driver 102), display signals (hereinafter, these signals being referred to as blanking signals) which mask the display signals which are already held in the pixel array (the image data which are inputted to the pixel array in one preceding frame period) are written M times. In this driving method of the display device 100, the first step in which the display signals are sequentially generated from respective N-line image data using the data driver 102 and the display signals are outputted to the pixel array 101 sequentially (N times in total) in response to the horizontal clocks CL1 and the second step in which the above-mentioned blanking signals are outputted to the pixel array 101 in response to the horizontal clock CL1 M times are repeated. Although a further explanation of this driving method of the display device will be explained later in conjunction with FIG. 1, the above-mentioned N value is set to four and the above-mentioned M value is set to one in FIG. 5.

As shown in FIG. 5, the memory circuit 105 includes four line memories LNM 1 to 4 which perform writing and reading-out of data independently from each other, wherein the image data 120 for every line, which is sequentially inputted to the display device 100 in synchronism with the horizontal synchronizing signal HSYNC, is sequentially stored into one of these line memories 1 to 4 one after another. That is, the memory circuit 105 has a memory capacity for four lines. For example, in an acquisition period Tin of image data 120 for four lines by the memory circuit 105, the image data W1, W2, W3, W4 for four lines are inputted to the line memory 4 from the line memory 1 sequentially.

The acquisition period Tin of image data extends over a time which is substantially four times as long as the horizontal scanning period defined by the pulse interval of the horizontal synchronizing signal HSYNC included in the vide control signals 121. However, before this acquisition period Tin of image data is finished with storing of the image data into the line memory 4, the image data which is stored in the line memory 1, the line memory 2 and the line memory 3 in this period are sequentially read out as the image data R1, R2, R3 using the display control circuit 104. Accordingly, as soon as the acquisition period Tin of image data W1, W2, W3, W4 for four lines is finished, it is possible to start the storing of image data W5, W6, W7, W8 for the next four lines to the line memories 1 to 4.

In the above-mentioned explanation, the reference symbol affixed to every one line of the image data is changed between the time of inputting the image data to the line memory and the time of outputting the image data from the line memory. For example, W1 is affixed to the former and R1 is affixed to the latter. This reflects the fact that the image data for every one line includes the above-mentioned retrace period and when the image data is read out from any one of the line memories 1 to 4 in response to (in synchronism with) the horizontal clock CL1 having higher frequency than the above-mentioned horizontal synchronizing signal HSYNC, the retrace periods included in the image data are shortened. Accordingly, for example, compared to the length of the image data for one line (referred to as line data hereinafter) W1 inputted to the line memory 1 along a time axis, the length of the line data R1 outputted from the line memory 1 along a time axis is shorter, as shown in FIG. 5.

In the period from inputting of the line data to the line memory to outputting of the line data from the line memory, even when image information (for example, generating image of 1 line along the horizontal direction of the screen) included in the line data is not processed, the length of the image information along the time axis can be compressed as described above. Accordingly, between the completion of outputting of the 4-line image data R1, R2, R3, R4 from the line memories 1 to 4 and the start of outputting of the 4-line image data R5, R6, R7, R8 from the line memories 1 to 4, the above-mentioned extra time Tex is generated.

The 4-line image data R1, R2, R3, R4 which, is read out from the line memories 1 to 4, is transferred to the data driver 102 as the driver data 106, and display signals L1, L2, L3, L4, which respectively correspond to the image data R1, R2, R3, R4, are produced (display signals L5, L6, L7, L8 being also produced correspond to the image data R5, R6, R7, R8 for four lines which are read out next time). These display signals are respectively outputted to the pixel array 101 in response to the above-mentioned horizontal clock CL1 in the order indicated by the eye diagram of output display signals shown in FIG. 5. Accordingly, by allowing the memory circuit 105 to include at least a line memory (or a mass thereof) having a capacity of the above-mentioned N line, it is possible to input image data of one line inputted to the display device during a certain frame period to the pixel array during this frame period, and, hence, the response speed of the display device in response to inputting of image data can be enhanced.

On the other hand, as can be clearly understood from FIG. 5, the above-mentioned extra time Tex corresponds to time for outputting the image data of one line from the line memory in response to the above-mentioned horizontal clock CL1. In this embodiment, another or separate display signal is outputted to the pixel array a single time by making use of this extra time Tex. Another display signal according to this embodiment is a so-called blanking signal B which decreases the luminance of the pixel to which another display signal is inputted to a level equal to or below the luminance before another display signal is inputted to the pixel. For example, the luminance of the pixel which is displayed with a relatively high gray scale (white or bright gray color close to white in a monochromatic image display) before one frame period is decreased lower than the above-mentioned level in response to the blanking signal B. On the other hand, the luminance of the pixel which is displayed with a relatively low gray scale (black or dark gray color like charcoal gray close to black in a monochromatic image display) before one frame period is hardly changed even after the inputting of the blanking signal B. This blanking signal B temporarily converts the image generated in the pixel array for every frame period into a dark image (blanking image). Due to such a display operation of the pixel array, even with respect to a hold-type display device, the image display in response to the image data inputted to the display device for every frame period can be performed in the same manner as the image display of an impulse type display device.

By applying the above-mentioned driving method of the display device which repeats the first step in which N-line image data is sequentially outputted to the pixel array and the second step in which the blanking signal B is outputted to the pixel array M times to the hold-type display device, an image display produced by a hold-type display device can be performed in the same manner as an image display produced by an impulse-type display device. This driving method of the display device is applicable not only to the display device which has been explained in conjunction with FIG. 5 and includes a line memory having a capacity of at least N lines as the memory circuit 105, but also, for example, to a display device in which the memory circuit 105 is replaced with a frame memory.

Such a driving method of the display device will be further explained in conjunction with FIG. 1. Although the operation of the display device in the above-mentioned first and second steps calls for outputting of the display signals using the data driver 102 in the display device 100 shown in FIG. 3, the outputting of the scanning signals (selection of pixel rows) using the scanning driver 103, which is performed corresponding to outputting of the display signals, is described as follows. In the explanation set forth hereinafter, the term "scanning signal", which is applied to the gate line (scanning signal line) 10 and serves to select the pixel row (a plurality of pixels PIX arranged along the gate line) corresponding to the gate line 10, indicates pulses (gate pulses) of the scanning signals which cause the scanning signals respectively applied to the gate lines G1, G2, G3, shown in FIG. 1 to assume a High state. In the pixel array shown in FIG. 9, the switching element SW which is provided to the pixel PIX receives a gate pulse through the gate line 10 connected to the switching element SW and allows the display signal supplied from the data line 12 to be inputted to the pixel PIX.

During the period corresponding to the above-mentioned first step, for every outputting of the display signal corresponding to N-line image data, the scanning signal which selects the pixel row corresponding to the Y line of the gate line is applied to the Y line of the gate line. Accordingly, the scanning signal is outputted N times from the scanning driver 103. Such an application of the scanning signal is sequentially performed in the direction from one end (for example, an upper end in FIG. 3) to another end of the pixel array 101 (for example, a lower end in FIG. 3) every other Y lines of gate lines for the above-mentioned every outputting of the display signal. Accordingly, in the first step, the pixel rows corresponding to gate lines of (Y×N) lines are selected and the display signals generated based on the image data are supplied to respective pixel rows. FIG. 1 shows the output timing (see the eye diagram of data driver output voltage) of the display signals when the value of N is set to four and the value of Y is set to one and waveforms of the scanning signals which are applied to respective gate lines (scanning lines) corresponding to the output timing.

Here, the period of the first step corresponds to the data driver output voltages 1 to 4, 5 to 8, 9 to 12, 513 to 516, . . . respectively.

For the data drive output voltages 1 to 4, the scanning signal is sequentially applied to the gate lines G1 to G4. For the next data drive output voltages 5 to 8, the scanning signal is sequentially applied to the gate lines G5 to G8. After a lapse of further time, for the data drive output voltages 513 to 516, the scanning signal is sequentially applied to the gate lines G513 to G516. That is, the outputting of scanning signals from the scanning driver 103 is sequentially performed in a direction such that the address number (G1, G2, G3, . . . , G257, G258, G259, . . . , G513, G514, G515, . . . ) of the gate line 10 in the pixel array 101 is increased.

On the other hand, during the period corresponding to the above-mentioned second step, for every M-times of outputting of the display signal, the scanning signal which selects the pixel rows corresponding to the Z-line of the gate lines is applied to the line Z of the gate lines as a blanking signal. Accordingly, the scanning signal is outputted M times from the scanning driver 103. The combination of gate lines (scanning lines) to which the scanning signal is applied for outputting of the scanning signal from the scanning driver 103 a single time is not particularly limited. However, from the viewpoint of achieving a long holding of the display signal supplied to the pixel row in the first step and reducing the load applied to the data driver 102, it is preferable to sequentially apply the scanning signal to every other Z lines of gate lines for every outputting of the display signal. The application of the scanning signal to the gate lines in the second step is sequentially performed from one end of the pixel array 101 to the other end of the pixel array 101 in the same manner as the first step. Accordingly, in the second step, the pixel rows corresponding to the gate lines consisting of (Z×M) lines are selected and the blanking signal is supplied to respective pixel rows.

FIG. 1 shows the output timing of the blanking signals B in the second step, which follows the first step, when the value of M is set to one and the value of Z is set to four and waveforms of the scanning signals which are applied to respective gate lines (scanning lines) corresponding to the output timing. In the second step, which follows the first step, in which the scanning signal is sequentially applied to the gate lines G1 to G4, for outputting the blanking signal B a single time, the scanning signal is sequentially applied to four gate lines ranging from G257 to G260. Then, in the second step, which follows the first step, in which the scanning signal is sequentially applied to the gate lines G5 to G8, for outputting of the blanking signal B a single time, the scanning signal is sequentially applied to four gate lines ranging from G261 to G264. Further, in the second step, which follows the first step, in which the scanning signal is sequentially applied to the gate lines G513 to G516, for outputting the blanking signal B a single time, the scanning signal is sequentially applied to four gate lines ranging from G1 to G4.

As described above, in the first step, the scanning signal is sequentially applied to four gate lines, respectively, while in the second step, to apply the scanning signal to four gate lines collectively or simultaneously, for example, in response to outputting of the display signal from the data driver 102, it is necessary to match the operation of the scanning driver 103 to the respective steps. As mentioned previously, the pixel array used in this embodiment has a resolution of the WXGA class, and gate lines consisting of 768 lines are juxtaposed to the pixel array. On the other hand, a group of four gate lines (for example, G1 to G4) which are sequentially selected in the first step and a group of four gate lines (for example, G257 to G260) which are sequentially selected in the second step, which follows the first step, are spaced apart from each other by the gate lines consisting of 252 lines along the direction that the address number of the gate lines 10 in the pixel array 101 is increased. Accordingly, the gate lines consisting of 768 lines which are juxtaposed in the pixel array are divided into three groups each consisting of 256 lines along the vertical direction thereof (or extending direction of the data lines), and the outputting operation of scanning signals from the scanning driver 103 is independently controlled for every group. To enable such a control, in the display device shown in FIG. 3, three scanning drivers 103-1, 103-2, 103-3 are arranged along the pixel array 101, and the outputting operation of scanning signals from respective scanning drivers 103-1, 103-2, 103-3 are controlled in response to the scanning state selection signals 114-1, 114-2, 114-3.

For example, when the gate lines G1 to G4 are selected in the first step and the gate lines G257 to G260 are selected in the second step which follows the first step, the scanning state selection signal 114-1 instructs the scanning driver 103-1 to assume a scanning state in which outputting of the scanning signal for sequentially selecting the gate line for four continuous pulses of the scanning clock CL3 one after another and stopping of the outputting of the scanning signals for one pulse of the scanning clock CL3 which follows the outputting of the scanning signal are repeated. On the other hand, the scanning state selection signal 114-2 instructs the scanning driver 103-2 to assume a scanning state in which stopping of the outputting of scanning signals for four continuous pulses of the scanning clock CL3 and outputting of scanning signals to four line gate lines for one pulse of the scanning clock CL3 which follows the stopping of outputting are repeated. Further, the scanning state selection signal 114-3 makes the scanning clock CL3 inputted to the scanning driver 103-3 ineffective and stops the outputting of the scanning signal initiated by the scanning clock CL3. The respective scanning drivers 103-1, 103-2, 103-3 are provided with two control signal transfer networks corresponding to the above-mentioned two instructions by the scanning state selection signals 114-1, 114-2, 114-3.

On the other hand, the waveform of a scanning start signal FLM shown in FIG. 1 includes two pulses which rise at points of time t1 and t2. A series of gate line selection operations in the above-mentioned first step are started in response to the pulse (described as pulse 1, hereinafter referred to as the first pulse) of the scanning start signal FLM which is generated at the point of time t1, while a series of gate line selection operations in the above-mentioned second step are started in response to the pulse of the scanning start signal FLM (described as pulse 2, hereinafter referred to as the second pulse) which is generated at the point of time t2. The first pulse of the scanning start signal FLM also responds to the start of inputting image data (defined by a pulse of the above-mentioned vertical synchronizing signal VSYNC) to the display device during one frame period. Accordingly, the first pulse and the second pulse of the scanning start signals FLM are repeatedly generated in every frame period.

Further, by adjusting the interval between the first pulse of the scanning start signal FLM and the second pulse which follows the first pulse of the scanning start signal FLM and the interval between this second pulse and the pulse which follows the second pulse (for example, the first pulse of the next frame period), the time for holding the display signal based on image data in the pixel array during one frame period can be adjusted. That is, the pulse interval including the first pulse and the second pulse generated on the scanning start signal FLM can take two different values (time widths) alternately. On the other hand, the scanning start signal FLM is generated by the display control circuit (timing controller) 104. From the above, the above-mentioned scanning state selection signals 114-1, 114-2, 114-3 can be generated in reference to the scanning start signal FLM in the display control circuit 104.

FIG. 1 shows an example of the operation in which every time the image data shown in FIG. 1 is written four times in the pixel array for every single line, the blanking signal is written in the pixel array a single time. As has been explained in conjunction with FIG. 5, such a blanking signal writing operation is completed within the time necessary for inputting the image data for four lines to the display device. Further, in response to the above-mentioned operation, the scanning signal is outputted to the pixel array five times. Accordingly, the horizontal period necessary for operating the pixel array becomes 4/5 of the horizontal scanning period of the video control signal 121. In this manner, inputting of the image data (display signals based on the image data) and the blanking signal to be inputted to the display device during one frame period to all of the pixels within the pixel array is completed within this one frame period.

The blanking signal shown in FIG. 1 generates pseudo image data (hereinafter referred to as blanking data) in the display control circuit 104 and the peripheral circuit thereof. Here, the pseudo image data may be transferred to the data driver 102 and the blanking data may be generated in the data driver 102. Alternatively, a circuit which generates the blanking signal may be preliminarily formed in the data driver 102 and the blanking signal may be outputted to the pixel array 101 in response to a specific pulse of the horizontal clock CL1 transferred from the display control circuit 104.

In the former case, a frame memory is provided in the display control circuit 104 or in the vicinity of the display control circuit 104 and the pixel in which the blanking signal is to be strengthened based on the image data for every frame period (pixel displayed with high luminance due to the image data) stored in the frame memory is specified using the display control circuit 104, and the blanking data which makes the data driver 102 generate a blanking signal which differs in darkness in response to the pixel may be generated.

In the latter case, the number of pulses of the horizontal clock CL1 is counted by the data driver 102 so as to make the data driver 102 output a display signal which enables the pixel display black or dark color close to black (for example, color such as charcoal gray) in response to the count number. At a portion of the liquid crystal display device, a plurality of gray scale voltages, which determine the luminance of the pixels, are generated by the display control circuit (timing converter) 104. In such a liquid crystal display device, a plurality of gray scale voltages are transferred by the data driver 102, the gray scale voltages corresponding to the image data are selected and are outputted to the pixel array by the data driver 102. In the same manner, the blanking signals may be generated by selection of the gray scale voltages in response to pulses of the horizontal clock CL1 due to the data driver 102.

The manner of outputting display signals to the pixel array and the manner of outputting scanning signals to respective gate lines (scanning lines) corresponding to the display signals according to the present invention shown in FIG. 1 are suitable for driving the display device having the scanning driver 103, which has a function of simultaneously outputting the scanning signal to a plurality of gate lines in response to the inputted scanning state selection signal 114. On the other hand, without simultaneously outputting the scanning signal to a plurality of scanning lines as explained above, by making the respective scanning drivers 103-1, 103-2, 103-3 sequentially output scanning signals for every single line of the gate lines (scanning lines) for every pulse of the scanning clock CL3, the image display operation according to the present invention can be performed. The image display operation of this embodiment in which inputting of the blanking data into four of other pixel rows (the above-mentioned first step in which the blanking data are outputted a single time) is repeated every time the image data of four lines is sequentially inputted to one of the pixel rows, one after another (the above-mentioned first step in which the image data are outputted four times), due to such operations of the scanning drivers 103 will be explained in conjunction with respective output waveforms of the display signals and the scanning signals shown in FIG. 4.

With respect to the driving method of the display device which is shown in FIG. 4, the display device shown in FIG. 3 will be referred to in the same manner as FIG. 1. Each scanning driver 103-1, 103-2, 103-3 includes 256 terminals for outputting the scanning signals. That is, each scanning driver 103 can output the scanning signals to gate lines consisting of 256 lines at a maximum. On the other hand, the pixel array 101 (for example, the liquid crystal display panel) is provided with gate lines 10 consisting of 768 lines and pixel rows which correspond to the respective gate lines. Accordingly, three scanning drivers 103-1, 103-2, 103-3 are sequentially arranged at one side of the pixel array 101 along the vertical direction (extending direction of the data lines 12 provided to the pixel array). The scanning driver 103-1 outputs the scanning signals to a group of gate lines G1 to G256, the scanning driver 103-2 outputs the scanning signals to a group of gate lines G257 to G512, and the scanning driver 103-3 outputs the scanning signals to a group of gate lines G513 to G768 so as to control the image display on the whole screen (the whole region of the pixel array 101) of the display device 100.

The display device to which the driving method explained in conjunction with FIG. 1 is applied and the display device to which the driving method explained hereinafter in conjunction with FIG. 4 is applied are similar with respect to the point that they both have the above-mentioned arrangement of scanning drivers. Further, with respect to the provision that the waveform of the scanning start signal FLM includes a first pulse which starts the outputting of a series of scanning signals which serve for inputting the image data to the pixel array and a second pulse which starts the outputting of a series of scanning signals which serve for inputting the blanking data to the pixel array in every frame period, the driving method of the display device which is explained in conjunction with FIG. 1 and the driving method of the display device which is explained in conjunction with FIG. 4 are similar. Further, also with respect to the provision that the scanning driver 103 acquires the first pulse and the second pulse of the above-mentioned scanning start signal FLM in response to the scanning clock CL 3 and, thereafter, terminals (or a group of terminals) from which the scanning signals are to be outputted in response to the scanning clock CL3 are sequentially shifted in response to the acquisition of the image data or the blanking data into the pixel array, the driving method of the display device using the signal waveforms shown in FIG. 1 and the driving method of the display device using the signal waveforms shown in FIG. 4 are similar.

However, the driving method of the display device of this embodiment which relates to FIG. 4 differs from the driving method depicted in FIG. 1 in the roles of the scanning state selection signals 114-1, 114-2, 114-3. In FIG. 4, respective waveforms of the scanning state selection signals 114-1, 114-2, 114-3 are indicated as DISP1, DISP2, DISP3. The scanning state selection signals 114, first of all, determine the output operations of the scanning signals in the regions which the scanning state selection signals 114 control (a group of pixels corresponding to a group of gate lines G257 to G512 in case of DISP2, for example) in response to operational conditions applied to these regions. In FIG. 4, in the period in which the data driver output voltages exhibit outputs of the display signals L513 to L516 in response to the image data of four lines (the above-mentioned first step in which the display signals L513 to L516 are outputted), the scanning signals are applied to the gate lines G513 to G516 from the scanning driver 103-3 corresponding to the pixel rows to which these display signals are inputted. Accordingly, the scanning state selection signal 114-3 which is transferred to the scanning driver 103-3 performs a so-called gate line selection for every single line which sequentially outputs the scanning signal for every single line of the gate lines G513 to G516 in response to the scanning clock CL3 (for every outputting of the gate pulse a single time). Accordingly, the display signal L513 is supplied to the pixel rows corresponding to the gate line G513 over one horizontal period (defined by the pulse interval of the horizontal clock CL1). Then, the display signal L514 is supplied to the pixel rows corresponding to the gate line G514 over one horizontal period. Subsequently, the display signal L515 is supplied to the pixel rows corresponding to the gate line G515 over one horizontal period. Finally, the display signal L516 is supplied to the pixel rows corresponding to the gate line G516 over one horizontal period.

On the other hand, in the above-mentioned second step, which follows the first step, and in which these display signals L513 to L516 are sequentially outputted for every horizontal period (in response to the pulse of the horizontal clock CL1), the blanking signal B is outputted in one horizontal period which follows four horizontal periods corresponding to the first step. In this embodiment, the blanking signal B which is outputted between outputting of the display signal L516 and outputting of the display signal L517 is supplied to respective pixel rows corresponding to the group of gate lines G5 to G8. Accordingly, the scanning driver 103-1 is required to perform a so-called 4-line simultaneous gate-line selection which applies the scanning signal to all four lines of the gate lines G5 to G8 within the outputting period of the blanking signal B. However, in the display operation of the pixel array according to FIG. 4, as mentioned above, although the scanning driver 103 starts the application of scanning signal to only one gate line in response to the scanning clock CL3 (for the pulse generated a single time), the scanning driver 103 does not start the application of scanning signal to a plurality of gate lines. That is, the scanning driver 103 does not simultaneously raise the scanning signal pulses for a plurality of gate lines.

Accordingly, the scanning state selection signal 114-1 transferred to the scanning driver 103-1 applies the scanning signal to at least (Z−1) lines out of Z lines of gate lines to which the scanning signal is to be applied before outputting the blanking signal B, and it controls the scanning driver 103-1 such that the application time of the scanning signal (pulse width of the scanning signal) is prolonged to a period which is at least N times as long as the horizontal period. These variables Z, N are the selection number: Z of gate lines in the second step and the outputting number: N of display signals in the first step, which are described in the explanation of the first step for writing the image data to the pixel array and the second step for writing the blanking data to the pixel array. For example, scanning signals are respectively applied to the gate lines G5 to G8 in the following manner. That is, the scanning signal is supplied to the gate line G5 from an outputting start time of the display signal L514 over a period which is five times as long as the horizontal period. The scanning signal is supplied to the gate line G6 from an outputting start time of the display signal L515 over a period which is five times as long as the horizontal period. The scanning signal is supplied to the gate line G7 from an outputting start time of the display signal L516 over a period which is five times as long as the horizontal period. The scanning signal is supplied to the gate line G8 from an outputting completion time of the display signal L516 (outputting start time of the blanking signal B which follows the gate line G8) over a period which is five times as long as the horizontal period. That is, although the respective rising times of the gate pulses of a group of gate lines G5 to G8 due to the scanning driver 103 are sequentially shifted for every one horizontal period in response to the scanning clock CL3, by delaying the respective falling times of the respective gate pulses after N horizontal periods of the rising time, all of the gate pulses of the groups of gate lines G5 to G8 are made to assume a state in which the gate pulses rise (High in FIG. 4) during the above-mentioned blanking signal outputting period. In controlling the outputting of the gate pulses in this manner, it is preferable to make the scanning driver 103 have a shift register function. Here, hatched regions indicated in the gate pulses of the gate lines G1 to G12 in which the blanking signal is supplied to the corresponding pixel rows will be explained later.

On the other hand, between this period (the above-mentioned first step in which the display signals L513 to L516 are outputted) and the second step which follows the first step, the display signals are not supplied to the pixel rows which correspond to the group of gate lines G257 to G512 which receive the scanning signals from the scanning driver 103-2. Accordingly, the scanning state selection signal 114-2 which is transferred to the scanning driver 103-2 causes the scanning clock CL3 to be ineffective for the scanning driver 103-2 during the period extending over the first step and the second step. Such an operation to make the scanning clock CL3 ineffective using the scanning state selection signal 114 is applicable at a given timing to a case in which the display signals and the blanking signals are supplied to the group of pixels within the region to which the scanning signals are outputted from the scanning driver 103 to which the scanning state selection signal 114-2 is transferred. In FIG. 4, the waveform of the scanning clock CL3 corresponding to the scanning signal output from the scanning driver 103-1 is shown. Although the pulse of the scanning clock CL3 is generated in response to the pulse of the horizontal clock CL1 which defines an output of the interval of the display signal and the blanking signal, the pulses are not generated at the output start time of the display signals L513, L517 . . . . In this manner, the operation to make the scanning clock CL3 transferred to the scanning driver 103 from the display control circuit 104 ineffective at a specific time can be performed using the scanning state selection signal 114. The operation to make the scanning clock CL3 partially ineffective for the scanning driver 103 may be performed such that a signal processing path corresponding to the scanning clock CL3 is incorporated in the scanning driver 103 and the operation of the signal processing path may be started in response to the scanning state selection signal 114 transferred to the scanning driver 103. Here, although not shown in FIG. 4, the scanning driver 103-3 which controls writing of the image data to the pixel array also becomes dead for the scanning clock CL3 at the outputting start time of the blanking signal B. Accordingly, it is possible to prevent the scanning driver 103-3 from erroneously supplying the blanking signal to the pixel rows to which the display signals based on the image data are supplied in the first step which follows the second step due to outputting of the blanking signal B.

Next, the scanning state selection signals 114 make the pulses of the scanning signals (gate pulses) which are sequentially generated in the regions which the scanning state selection signals 114 respectively control ineffective at a stage in which the gate pulses are outputted to the gate lines. This function, in the driving method of the display device shown in FIG. 4, makes the scanning state selection signal 114 transferred to the scanning driver 103 concerned with the signal processing inside the scanning driver 103 which supplies the blanking signal to the pixel array. Three waveforms DISP1, DISP2, DISP3 shown in FIG. 4 show those of the scanning state selection signals 114-1, 114-2, 114-3 which are concerned with the signal processing inside the respective scanning drivers 103-1, 103-2, 103-3.

When these waveforms DISP1, DISP2, DISP3 are at Low-level, outputting of the gate pulse becomes effective. Further, the waveform DISP1 of the scanning state selection signal 114-1 assumes the High-level during the period in which the display signals are outputted to the pixel array in the above-mentioned first step so as to make outputting of the gate pulse generated by the scanning driver 103-1 during this period ineffective.

For example, the gate pulses which are generated on the scanning signals respectively corresponding to the gate lines G1 to G7 during four horizontal periods in which the display signals L513 to L516 are supplied to the pixel array have respective outputs thereof that are ineffective as indicated by hatching in response to the scanning state selection signal DISP1 which assumes the High-level during this period. Accordingly, it is possible to prevent the display signals based on the image data from being erroneously supplied to the pixel rows to which the blanking signals are to be supplied during a certain period; and, hence, the blanking display due to these pixel rows (erasing of images displayed in these pixel rows) can be surely produced, and, at the same time, the loss of intensity of the display signals based on the image data per se can be prevented. Further, during one horizontal period in which the blanking signal B is outputted and which is arranged between four horizontal periods which output the display signals L513 to L516 and the next four horizontal periods which output the display signals L517 to L520, the scanning state selection signal DISP1 assumes the Low-level. Accordingly, the gate pulses which are generated on the scanning signals corresponding to respective gate lines G5 to G8 during these periods are collectively outputted to the pixel array, the pixel rows corresponding to these gate lines consisting of four lines are simultaneously selected, and the blanking signals B are supplied to the respective pixel rows.

As described above, in the display operation of the display device shown in FIG. 4, based on the scanning state selection signals 114, it is possible to determine not only the operational state of the scanning driver 103 to which the scanning state selection signal 114 is transferred (the operational state of either one of the above-mentioned first step and the above-mentioned second step or the non-operational state which depends on neither of them) but also the validity of outputting of the gate pulses generated by the scanning driver 103 in response to these operational states. Here, a series of controls of the scanning driver 103 (outputting of scanning signals from the scanning driver 103) based on these scanning state selection signals 114 are started from outputting of the scanning signal to the gate line G1 in response to the scanning start signal FLM with respect to both the writing of the display signals based on the image data to the pixel array and the writing of the blanking signals. FIG. 4 mainly shows the line selection operation (four line simultaneous selection operation) of the gate lines using the scanning driver 103 which is sequentially shifted by the scanning state selection signal DISP1 in response to the above-mentioned second pulse of the scanning start signal FLM. Although not shown in FIG. 4, due to the operation of the display device in response to the scanning state selection signal DISP1, the selection operation of gate line for every single line using the scanning driver 103 is sequentially shifted in response to the first pulse of the scanning start signals FLM. Accordingly, also in the operation of the display device shown in FIG. 4, it is necessary to start scanning of two types of the pixel arrays a single time for each in response to the scanning start signal FLM for every frame period; and, hence, as the waveform of the scanning start signal FLM, the first pulse and the second pulse which follows the first pulse appear.

In both of the above-mentioned driving methods of the display device shown in FIG. 1 and FIG. 4, the number of the scanning drivers 103 which are arranged along one side of the pixel array 101 and the number of scanning state selection signals 114 which are transmitted to the scanning drivers 103 can be changed without changing the structure of the pixel array 101 which has been explained in conjunction with FIG. 3 and FIG. 9, wherein respective functions which are shared by three scanning drivers 103 may be collectively performed by one scanning driver 103 (for example, the internal configuration of the scanning driver 103 is divided into circuit sections respectively corresponding to the above-mentioned three scanning drivers 103-1, 103-2, 103-3).

FIG. 6 is a timing chart showing image display timing of a display device of this embodiment over three continuous frame periods. At the beginning of each frame period, writing of image data from the first scanning line SCSL (corresponding to the above-mentioned gate line G1) to the pixel array is started in response to the first pulse of the scanning start signal FLM. After a lapse of time: Δt1 from this point of time, writing of the blanking data from the first scanning line to the pixel array is started in response to the second pulse of the scanning start signal FLM. Further, after a lapse of time: Δt2 from the point of time that the second pulse of the scanning start signal FLM is generated, writing of image data to be inputted to the display device to the pixel array in the next frame period is started in response to the first pulse of the scanning start signal FLM. Here, in this embodiment, time: Δt1' shown in FIG. 6 is equal to the time: Δt1 and time: Δt2' shown in FIG. 6 is equal to time Δt2. With respect to the advance of writing of image data PCD to the pixel array and the advance of writing of the blanking data BLD, although they differ in the number of lines (the former: one line, the latter, four lines) of gate lines which they select during one horizontal period, these writings advance substantially equally with respect to the lapse of time.

Accordingly, irrespective of the positions of the scanning lines in the pixel array, the period that the pixel rows which correspond to respective scanning lines hold display signals based on the image data (substantially covering the above-mentioned time Δt1: including the time for receiving the display signals) and the period in which the pixel rows hold the blanking signal (substantially covering the above-mentioned time: Δt2 including the time for receiving the blanking signal) become substantially uniform over the vertical direction of the pixel array. That is, the irregularities of display luminance between the pixel rows (along the vertical direction) in the pixel array can be suppressed. In this embodiment, 67% and 33% of one frame are respectively allocated to the display period of the image data in the pixel array and the display period of the blanking data, as shown in FIG. 6, and the timing adjustment of the scanning start signal FLM corresponding to the allocation of the frame period is performed (the above-mentioned times Δt1 and Δt2 are adjusted). However, by changing the timing of the scanning start signal FLM, the display period of the image data and the display period of the blanking data can be suitably changed.

One example of the luminance response of the pixel rows, when the display device is operated at the image display timing shown in FIG. 6, is shown in FIG. 7. In this luminance response, a liquid crystal display panel which has the resolution of WXGA class and is operated in the normally black display mode is used as the pixel array 101 shown in FIG. 3, and the display ON data which display the pixel rows in white are written in the pixel rows as the image data, while display OFF data which display the pixel rows in black are written in the pixel rows as the blanking data. Accordingly, the luminance response shown in FIG. 7 shows a change of optical transmissivity of the liquid crystal layer corresponding to the pixel rows of the liquid crystal display panel. As shown in FIG. 7, pixel rows (each pixel included in these pixel rows), during one frame period, respond to the luminance corresponding to the image data first of all and, thereafter, respond to the black luminance. Although the optical transmissivity of the liquid crystal layer responds to the change of an electric field applied to the liquid crystal layer relatively gradually, as clearly understood from FIG. 7, the value of optical transmissivity sufficiently responds to the electric field corresponding to the image data PCD for every frame period FLAME and an electric field corresponding to the blanking data BCD. Accordingly, with respect to an image due to image data generated on the screen (pixel rows) during the frame period, the image is sufficiently erased from the screen (pixel rows) within the frame period; and, hence, the image is displayed in the same state as an impulse type display device. Due to such an impulse-type response of the image based on the image data, blurring of an animated image which is generated on the display can be reduced. Such an advantageous effect can be obtained in the same manner by changing the resolution of the pixel array or by changing the rate of the retrace period in the horizontal period of the driver data shown in FIG. 2.

In the above-mentioned embodiment, in the first step, the display signals which are generated for every single line of image data are sequentially outputted to the pixel array four times and are respectively sequentially supplied to the pixel row corresponding to one line of the gate lines, and, in the succeeding second step, the blanking signals are sequentially outputted to the pixel array a single time and are supplied to the pixel rows corresponding to four lines of gate lines. However, the outputting number: N (this value also corresponding to the number of line data written in the pixel array) of the display signals in the first step is not limited to four, while the outputting number: M of the blanking signals in the second step is not limited to one. Further, the line number: Y of the gate lines to which the scanning signals (selection pulses) are applied for single outputting of the display signals in the first step is not limited to one, while the line numbers: Z of the gate lines to which the scanning signal is applied for single blanking signal output in the second step is not limited to four. These factors N, M are required to be natural numbers which satisfy the condition that M<N and N is required to be two or more. Further, it is also required that the factor Y is a natural number smaller than N/M and the factor Z is a natural number equal to or greater than N/M. Still further, one cycle in which N-time display signal outputting and M-time blanking signal outputting are performed is completed within a period in which N-line image data are inputted to the display device. That is, the value which is (N+M) times as large as the horizontal period in the operation of the pixel array is set to a value equal to or smaller than the value which is N times as large as the horizontal scanning period in inputting of the image data to the display device. The former horizontal period is defined by the pulse interval of the horizontal clock CL1, while the latter horizontal scanning period is defined by the pulse interval of the horizontal synchronizing signal HSYNC which constitutes one of the video control signals.

According to such operational conditions of the pixel array, during the period Tin in which N-line image data are inputted to the display device, the (N+M) times signal outputting from the data driver 102 is performed, that is, the pixel array operation of one cycle consisting of the first step and the second step which follows the first step is performed. Accordingly, the time (referred to as Tinvention hereinafter) allocated respectively to the outputting of display signals and the outputting of blanking signals in this one cycle is reduced to a value which is (N/(N+M)) times as large as the time (referred to as Tprior hereinafter) necessary for outputting a signal a single time for sequentially outputting the display signal corresponding to the N-line image data during the period Tin. However, since the factor M is a natural number smaller than N, according to the present invention, the outputting period Tinvention of the present invention in which signals during one cycle are outputted can ensure a time length which is equal to or longer than ½ of the above-mentioned Tprior. That is, from a viewpoint of writing the image data to the pixel array, an advantageous effect described in the above-mentioned SID 01 Digest, pages 994 to 997, is obtained relative to a technique described in the above-mentioned JP-A-2001-166280.

Further, according to the present invention, by supplying the blanking signals to the pixels during the period Tinvention, it is possible to rapidly lower the luminance of the pixel. Accordingly, compared to the technique described in SID 01 Digest, pages 994 to 997, according to the present invention, the video display period and the blanking display period of each pixel row during one frame period can be clearly divided; and, hence, the motion blur can be efficiently reduced. Further, in accordance with the present invention, although the supply of the blanking signals to the pixels is performed intermittently for every (N+M) times, the blanking signals can be supplied to the pixel row corresponding to Z-line gate lines with respect to a single blanking signal outputting, and, hence, the irregularities of ratio between the video display period and the blanking display period which is generated between the pixel rows can be suppressed. Further, by sequentially applying the scanning signal to the gate line every other Z line of the gate lines for every outputting of the blanking signal, the load for single outputting of the blanking signal from the data driver 102 can be also reduced due to the restriction on the number of pixel rows to which the blanking signal is supplied.

Accordingly, the driving of the display device according to the present invention is not limited to the example which has been explained in conjunction with FIG. 1 to FIG. 7 and in which N is set to four, M is set to one and Z is set to four. That is, so long as the above-mentioned conditions are satisfied, the driving of the display device according to the present invention is universally applicable to the overall driving of the hold-type display device. For example, when the image data are inputted to the display device in an interlace method through either one of odd-numbered lines and even-numbered lines for every frame period, the image data of the odd-numbered lines or the even-numbered lines are sequentially applied for every single line and the scanning signals are sequentially applied for every two lines of gate lines, and the display signals may be supplied to the pixel rows corresponding to them (in this case, at least the above-mentioned factor Y assuming 2). Further, in the driving of the display device according to the present invention, the frequency of the horizontal clock CL1 is set to a value which is ((N+M)/N) times (1.25 times in the examples shown in FIG. 1 and FIG. 4) as large as the frequency of the horizontal synchronizing signal HSYNC. However, the frequency of the horizontal clock CL1 may be increased further so as to narrow the pulse interval and to ensure the operational margin of the pixel array. In this case, a pulse oscillation circuit may be provided to or in the vicinity of the display control circuit 104, and, hence, the frequency of the horizontal clock CL1 may be increased in conjunction with the reference signal having a frequency higher than that of a dot clock DOTCLK included in the video control signals generated by the pulse oscillation circuit.

With respect to the above-mentioned respective factors, the factor N may preferably be set to the natural number of four or more, while the factor M may preferably be set to one. Further, the factor Y may preferably take the equal value as the factor M, while the factor Z may preferably take the equal value as the factor N.

Second Embodiment

Also, in this embodiment, in the same manner as the above-mentioned first embodiment, with respect to the image data which are inputted to the display device shown in FIG. 3 at the timing shown in FIG. 2, the display signals and the scanning signals are outputted from the data driver 102 with the waveforms shown in FIG. 1 or FIG. 4 and the display is produced in accordance with the display timing shown in FIG. 6. However, in this embodiment, the output timing of the blanking signals with respect to the outputting of the display signals based on the image data shown in FIG. 1 and FIG. 4 is changed every frame period as shown in FIG. 8.

Figure 8:
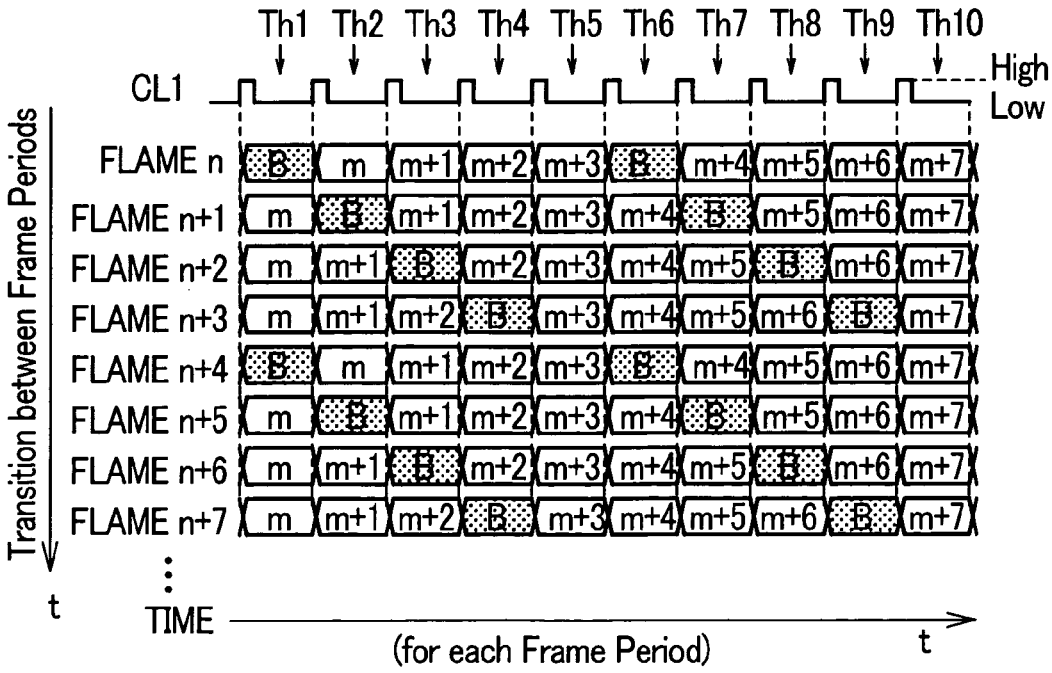
FIG. 8 is a diagram showing the change of display signals (m, m+1, m+2, . . . based on image data and B based on a blanking data) supplied to respective pixel rows corresponding to gate lines G1, G2, G3, . . . over a plurality of continuous frame periods n, n+1, n+2, . . . in a the second embodiment of the driving method of the liquid crystal display device according to the present invention.

In the display device using a liquid crystal display panel as the pixel array, the output timing of the blanking signals of this embodiment shown in FIG. 8 has an advantageous effect in that the influence of rounding of waveforms of the signals generated in the data lines of the liquid crystal display panel to which the blanking signals are supplied can be dispersed whereby the display quality of the image can be enhanced. In FIG. 8, periods Th1, Th2, Th3, . . . which respectively correspond to pulses of the horizontal clock CL1 are sequentially arranged in the lateral direction and, in any one of these periods, eye diagrams, each of which includes the display signals m, m+1, m+2, m+3, . . . for every single line of the image data outputted from the data driver 102 and the blanking signal B, are sequentially arranged in the longitudinal direction for every one of continuous frame periods n, n+1, n+2, n+3, . . . . The display signals m, m+1, m+2, m+3 described in this embodiment are not limited to the image data of specific lines and, for example, can be used as the display signals L1, L2, L3, L4 as well as the display signals L511, L512, L513, L514 in FIG. 1.

Every time the image data are written in the pixel array four times in the manner explained in conjunction with the first embodiment, the blanking data are written in the pixel array a single time. In this case, periods in which the blanking data are applied to the pixel array shown in FIG. 8 are sequentially changed for every frame from any one of the group of periods (for example, a group consisting of the periods Th1, Th6, Th12, . . . ) which are arranged every four other periods in the above-mentioned periods Th1, Th2, Th3, Th4, Th5, Th6, . . . to another group of periods (for example, a group consisting of periods Th2, Th7, Th13, . . . ). For example, in the frame period n, before inputting the mth line data into the pixel array (before applying the display signal based on the mth line data to the mth pixel row), the blanking data are inputted to the pixel array (the blanking data are applied to the pixel row corresponding to the given four lines of the gate lines). In the frame period n+1, after inputting the mth line data into the pixel array and before inputting the (m+1)th line data into the pixel array, the above-mentioned blanking data are inputted to the pixel array. Inputting of the (m+1)th line data to the pixel array follows that of the mth line data and the display signal based on the (m+1)th line data is applied to the (m+1)th pixel row. In succeeding inputting of respective line data to the pixel array, the display signal based on the line data is applied to the pixel row having the same address (order) as the line data.

In the frame period n+2, after inputting the (m+1)th line data into the pixel array and before inputting the (m+2)th line data into the pixel array, the blanking data are inputted to the pixel array. In the subsequent frame period n+3, after inputting the (m+2)th line data into the pixel array and before inputting the (m+3)th line data into the pixel array, the blanking data are inputted to the pixel array. Thereafter, such inputting of the line data and the blanking data to the pixel array is repeated by shifting or deviating the timing of the blanking data every one horizontal period and, in the frame period n+4, the inputting returns to the input pattern of the line data and the blanking data to the pixel array in the frame period n. By repeating a series of operations, the influence of the rounding of the signal waveforms which are generated along the extending direction of data line, when not only the blanking signal but also the display signal based on the line data are outputted to respective data lines of the pixel array, can be uniformly dispersed so that the quality of the image displayed on the pixel array can be enhanced.

Also, in this embodiment, in the same manner as the first embodiment, the display device can be operated at the image display timing shown in FIG. 6. In this embodiment, however, since the timing for applying the blanking signal to the pixel array is shifted every frame period as mentioned above, a point of time for generating the second pulse of the scanning start signal FLM which starts scanning of the pixel array by the blanking signal is deviated corresponding to the frame period. Corresponding to the change of the second pulse generating timing of the scanning start signal FLM, the time: Δt1 indicated in the frame period 1 in FIG. 6 becomes the time: Δt1' which is shorter (or longer) than the time: Δt1 in the succeeding frame period 2, and the time: Δt2 indicated in the frame period 1 becomes the time: Δt2' which is longer (or shorter) than the time: Δt2 in the succeeding frame period 2. To consider "the deviation" of the scanning start time of the pixel array on the display signals based on the line data m which is observed between a pair of frame periods n and n+1 and between another pair of frame periods n+3 and n+4 shown in FIG. 8, in this embodiment, at least one of two time intervals: Δt1, Δt2 corresponding to the pulse interval of the scanning start signal FLM is changed in response to the frame period.

As described above, when the display operation is performed following the image display timing shown in FIG. 6 in accordance with the driving method of the display device according to this embodiment, which the outputting period of blanking signal is shifted along the time axis direction for every frame period, some change is necessary in setting the scanning start signal. However, the advantageous effects obtained by this embodiment are almost comparable to the advantageous effects obtained by the first embodiment shown in FIG. 7. Accordingly, also in this embodiment, the image corresponding to the image data can be displayed on the hold-type display device substantially in the same manner as the impulse-type display device. Further, compared to the hold-type pixel array, the animated images do not damage the luminance, and, hence, it is possible to produce the display by reducing the motion blur generated in the animated image. Also, in this embodiment, the ratio between the display period of image data and the display period of blanking data during one frame period can be suitably changed by adjusting the timing of the scanning start signal FLM (for example, the distribution of the above-mentioned pulse intervals: Δt1, Δt2). Further, the applicable range of the driving method of this embodiment to the display device is not limited, as in the case of the driving method of the first embodiment, by the resolution of the pixel array (for example, liquid crystal display panel). Still further, in the display device according to this embodiment, in the same manner as the display device of the first embodiment, by suitably changing the ratio of the retrace period included in the horizontal period defined by the horizontal clock CL1, the outputting number: N of display signals in the first step and the line number: Z of the gate lines selected by the second step can be increased or decreased.

Third Embodiment

As explained in connection with the above-mentioned first embodiment, writing of the video data and writing of the blanking data are respectively started in response to the first pulse and the second pulse of the scanning start signal FLM (see FIG. 6).

That is, at the beginning of each frame period, writing of the video data into the pixel array from the first scanning line (corresponding to the gate line GL) is started in response to the first pulse of the scanning start signal FLM. Then, after a lapse of time: Δt1 from such a point of time, writing of the blanking data into the pixel array is started from the first scanning line in response to the second pulse of the scanning start signal FLM. Further, after a lapse of time: Δt2 from the point of time that the second pulse of the scanning start signal FLM is started, writing of the video data which is to be inputted to the display device during the next frame period into the pixel array is started in response to the first pulse of the scanning start signal FLM.

Further, as described above, the adjustment of timing (the adjustment of the above-mentioned times Δt1, Δt2) of the scanning start signal FLM can be performed, and, hence, the display period for video data and the display period for the blanking data can be changed.

In this case, the first pulse of the scanning start signal FLM is generated at the beginning of each frame period and the frame period (time) can be specified; and, hence, in the above-mentioned adjustment of the times Δt1 and Δt2, it is sufficient to input information corresponding to the time Δt1.

That is, the pulses of the horizontal synchronizing signal HSYNC contained in the video data may be counted from the beginning of each frame period; and, when the count value corresponding to the Δt1 is obtained, the second pulse of the scanning start signal FLM may be generated. Thereafter, at the beginning of the next frame, the first pulse of the scanning start signal FLM is generated, and this first pulse is generated after a lapse of the time Δt2 from the point of time of the generation of the second pulse of the scanning start signal FLM which is generated immediately before the first pulse.

However, as the video data from the external video signal source, for example, video data for a television receiver set, video data for a personal computer, video data for a DVD player or the like may be considered. Accordingly, when the video data is changed, a cycle of the horizontal synchronizing signal HSYNC contained in the video data is also changed. For example, when the cycle becomes small, even when the count value corresponding to the preset time Δt1 of the pulses of the horizontal synchronizing signal HSYNC from the beginning of the frame period is counted based on the preset information corresponding to the preset time Δt1, the count value does not correspond to the actual time, and, hence, the second pulse of the scanning start signal FLM is generated earlier than the preset information corresponding to the time Δt1. Accordingly, there arises a drawback in that the display period for blanking data during the frame period is prolonged.

This embodiment provides a display device which can overcome such a drawback. That is, this embodiment provides a display device in which the ratio between the display period for video data and the display period for blanking data is not changed even when the video data is changed.

Figure 10:
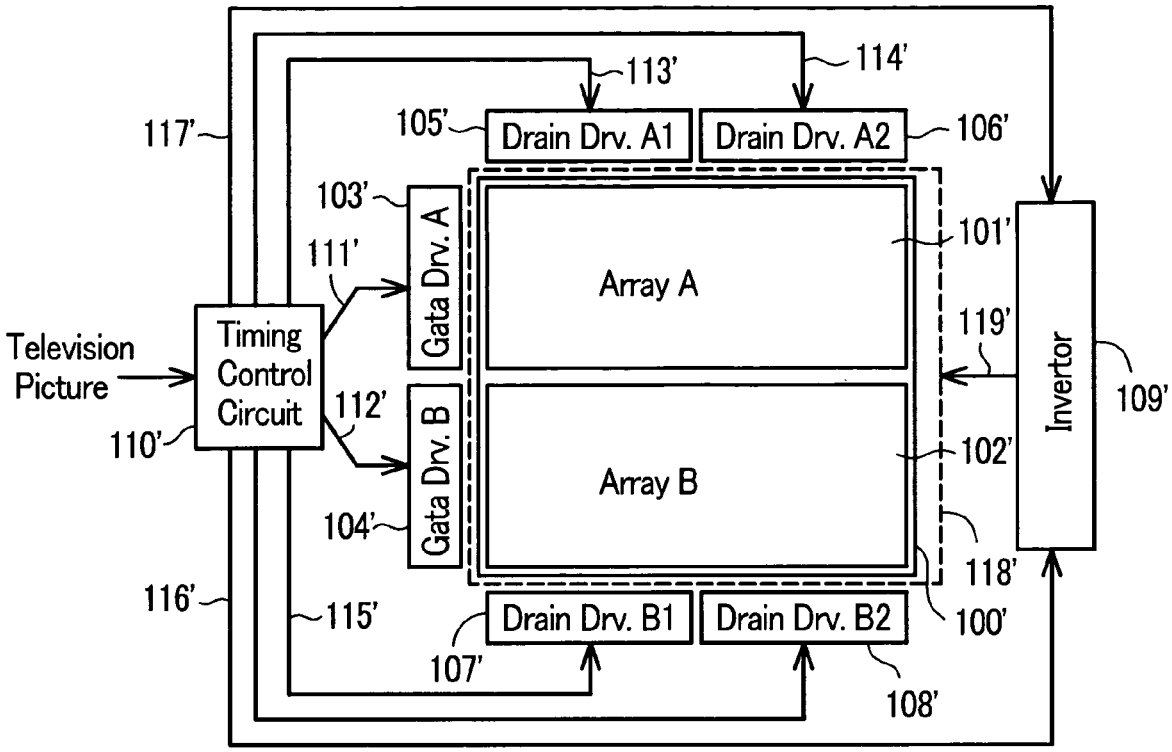
FIG. 10 is a block diagram showing the overall configuration of another liquid crystal display device according to the present invention.

FIG. 10 is a block diagram which shows the concept of the constitution of, for example, a liquid crystal display device to which this embodiment is applied.

The liquid crystal display device of this embodiment is also referred to as a liquid crystal display module; and, as shown in FIG. 10, it is divided into three sections consisting of a display element part including a liquid crystal display panel (a display panel) 100', a display control part including a circuit which is referred to as a timing controller 110', and a light source part including a backlight system (or a front-light system) 118'.

The display element part includes a pixel array in which a plurality of pixels are arranged two-dimensionally on a screen of the display panel, and image information inputted to the display device (display module) is displayed on the pixel array. In most of the flat panel displays which are represented by use of a liquid crystal display device, the display panel 100' is considered too be equivalent to the pixel array. In view of the atmosphere of the display device, with respect to a reflection type liquid crystal display device which produces an image display by reflecting light incident on the pixel array at respective pixels and an electroluminescence display array or a field emission-type display element which produces an image display by forming a light emitting region in each pixel in the pixel array and by making use of a light emitting phenomenon of these light emitting regions, it is possible to allow a user to watch (visualize) the image information inputted to the display device using the display element part (pixel array). However, the liquid crystal display device of this embodiment is a so-called "transmissive" liquid crystal display device, and, hence, unless light from the above-mentioned light source part is irradiated to the pixel array, the user cannot watch the image displayed on the pixel array.

According to the liquid crystal display device of this embodiment, the display panel 100'("screen" as viewed from the user) includes a pixel array A (an upper side of the screen) 101' and a pixel array B (a lower side of the screen) 102'. To respective pixel arrays 101', 102', a plurality of scanning signal lines which extend along the lateral direction (the first direction) and are arranged along the longitudinal direction (the second direction which crosses the first direction) in FIG. 10 and a plurality of video signal lines which extend along the longitudinal direction and are arranged along the lateral direction in FIG. 10 are provided. A specific arrangement and specific functions of these signal lines will be explained later in conjunction with FIG. 11, and the illustration of such an arrangement and function is omitted in FIG. 10.

The screen (an image display region) of the display panel 100' is formed by arranging two pixel arrays 101', 102' in parallel along the longitudinal direction (the direction in which the scanning signal lines are arranged in parallel or the direction in which the video signal lines extend). For example, with respect to the display panel 100' having a vertical screen resolution: M (M being a natural number), in the image display region of the pixel array A (upper-side pixel array) 101', N scanning signal lines counted from the first scanning signal line to the Nth (N being a natural number smaller than the above-mentioned M) scanning signal line are respectively arranged in parallel, while (M−N) scanning signal lines counted from the (N+1)th scanning signal line to Mth scanning signal line are respectively arranged in parallel. For example, with respect to the display panel 100' (M=768) having the definition of the XGA class, 400 scanning signal lines (pixel rows) counted from the first scanning signal line to the 400th scanning signal line are provided to the image display region of the pixel array 101' and 368 scanning signal lines (pixel rows) counted from the 401th scanning signal line to the 768th scanning signal line are provided to the image display region of the pixel array 102'. The numbers of scanning signal lines described here do not include so-called dummy scanning signal lines which are arranged at the peripheries of the image display regions of the respective pixel arrays. In the respective image display regions of the pixel arrays 101', 102', the same number of video signal lines are arranged, for example. However, the number of video signal lines of either one of the pixel arrays may be set larger or smaller than the number of video signal lines of the other pixel array. When the same number of video signal lines are provided to the image display regions of both pixel arrays, the video signal lines of the pixel array A and the video signal lines of the pixel array B are electrically separated from each other even when they are positioned at the same address (using the left end of FIG. 10 as the reference).

As described above, the display panel 100' of this embodiment includes two pixel arrays 101', 102' which are provided with so-called individual functions as display panels. Accordingly, to the respective pixel arrays 101', 102', a video signal driver circuit which outputs image signals to the video signal lines and a scanning signal driver circuit which selects the pixel rows to which the image signals are inputted by outputting the scanning signals to the scanning signal lines corresponding to the pixel rows are individually provided. The pixel array A (an upper-side pixel array) 101' is provided with a scanning signal driver circuit 103' which selects N pixel rows corresponding to the above-mentioned first to Nth scanning signal lines (inputs selection signals to the scanning signal lines) and video signal driver circuits 105', 106' which supply image signals to respective pixels included in the pixel rows selected by the scanning signal driver circuit 103'. The pixel array B (a lower-side pixel array) 102' is provided with a scanning signal driver circuit 104' which selects (M−N) pixel rows corresponding to the above-mentioned (N+1)th to Mth scanning signal lines and video signal driver circuits 107', 108' which supply image signals to the respective pixels included in the pixel rows selected by scanning signal driver circuit 104'.

The display control part includes a timing control circuit (a timing converter) 110' and signal supply bus lines 111' to 116' which extend from the timing control circuit 110' to the above-mentioned scanning signal drive circuits 103, 104' and the above-mentioned video signal driver circuits 105' to 108'. In the liquid crystal display device according to this embodiment, for example, the image information (the video information) transferred from a receiver set of a television device, a decoder of a DVD (Digital Versatile Disc) or the like is received by the timing control circuit 110', the image information is converted into image data (video data) which is suitable for image display at the display panel 100' by the timing control circuit 110' (or a peripheral circuit thereof), and the image data is transferred to the video signal driver circuits 105' to 108' through signal supply buses 113' to 116'. The above-mentioned image information which the timing control circuit 110' receives from the outside of the liquid crystal display device contains the image data and timing signals which transmit the image data (also referred to as "external clocks" as viewed from the display device).

The timing control circuit 110' also generates display control signals, such as clocks (latch clocks), which control the timing for latching the image data which is outputted from the timing control circuit 110' to latch circuits provided to the above-mentioned respective video signal driver circuits 105' to 108', clocks (scanning clocks) for control timings for supplying the image data latched at the vide signal driver circuits 105' to 108' to the pixels (pixel rows) of the pixel array A and the pixel array B, and clocks (frame starting signals) for controlling timings to update the display images in the pixel array A and the pixel array B. Accordingly, the timing control circuit 110' is also referred to as the display control circuit. The above-mentioned scanning clocks and the above-mentioned frame starting signals are transmitted to the scanning signal driver circuits 103', 104' through the signal supply buses 111', 112', while the above-mentioned latch clocks are transmitted to the video signal driver circuits 105' to 108' through the signal supply busses 113' to 116'. If required, the scanning clocks and the frame starting signals may be transferred also to the video signal driver circuits 105' to 108'.

In this embodiment, two video signal driver circuits (A1, A2) 105', 106' provided to the pixel array A (the upper-side pixel array) 101' and the timing control circuit 110' are individually connected by the signal supply busses 113', 114', while two video signal driver circuits (B1, B2) 107', 108' provided to the pixel array B (the lower-side pixel array) 102' and the timing control circuit 110' are individually connected by the signal supply busses 115', 116'.

Accordingly, the image data to be inputted to the display panel is transmitted from the timing control circuit 110' to the respective video signal driver circuits 105' to 108' in parallel through respective signal supply busses 113' to 116' for every ¼ of the total number of pixels included in the pixel display region. Further, as described above, the latch clocks are also respectively transmitted to the respective video signal driver circuits 105' to 108' through the signal supply buses 113' to 116'. Accordingly, in the display device of this embodiment, the image data necessary for the formation of the image over the whole screen (image display region) of the display panel 100' can be transferred rapidly from the display control part to the display element part within a time substantially equal to ¼ of one frame period, for example.

In this manner, the image data fetched in parallel to two video signal driver circuits A1, A2 provided to the pixel array A and two video signal driver circuits B1, B2 provided to the pixel array B of this embodiment are sequentially supplied to the respective pixel rows as image signals in response to the inputting of scanning signals in parallel to the pixel arrays A, B (101', 102') from the scanning signal driver circuits A, B (103', 104'). Since at least one pixel row arranged in the pixel array A and at least one pixel row arranged in the pixel array B are selected in response to the inputting of the scanning signals to the pixel arrays A, B (101', 102'), the image signals are simultaneously inputted to the display panel 100' from four video signal driver circuits A1, A2, B1, B2 (105', 106', 107', 108'). Accordingly, the image data which is rapidly transferred from the display control part to the display element part is instantaneously converted into the display images in the display element part. In this manner, according to the liquid crystal display device of this embodiment, the image information which is inputted within one frame period can be displayed over the whole region of the liquid crystal display panel 100' within ¼ of the time.

The light source part includes, for example, a light source unit 118' which is provided with a cold cathode fluorescent lamp, an inverter circuit 109' which drives the light source (generates light power), and a power source line 119' which supplies drive power from the inverter circuit 109' to the light source unit 118'. The light source such as the above-mentioned cold cathode fluorescent lamp may be arranged to face the display panel 100', or it may be arranged to irradiate light to the display panel 100' through a light guide plate (not shown in the drawing).

In this embodiment, a light source (for example, a cold cathode fluorescent lamp) in a light source part is intermittently driven or has a lighting luminance thereof modulated in response to display control signals generated by the above-mentioned timing control circuit 110'. Accordingly, an inverter circuit 109' which adjusts the lighting luminance of the light source and the timing control circuit 110' are connected to each other by the signal supply bus 117' and the luminance of the light source is controlled in response to the control signals from the timing control circuit 110'. The control signals transmitted to the inverter circuit 109' from the timing control circuit 110', for controlling the inverter circuit 109', may be generated by the timing control circuit 110', or it may be replaced with the above-mentioned scanning clocks or the frame starting signals which are already generated by the timing control circuit 110'. Accordingly, the lighting timing or the modulation of lighting luminance of the light source part is also controlled by the display control part.

Figure 11:
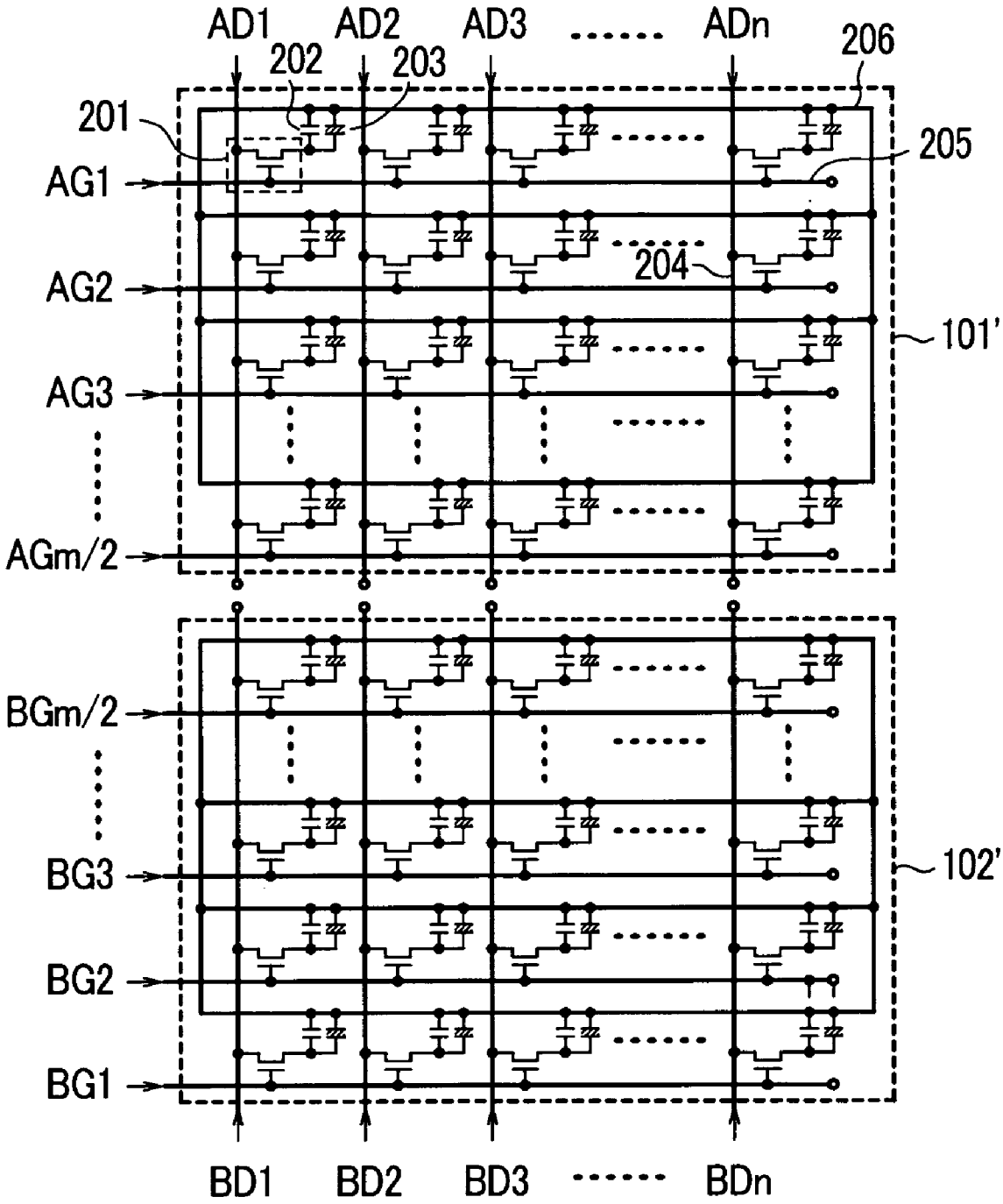
FIG. 11 is a schematic diagram showing another example of a pixel array provided to an active matrix type display device.

FIG. 11 shows an inner equivalent circuit of the pixel arrays 101', 102' which form the image display region of the active matrix type liquid crystal display device according to this embodiment. In both of the pixel arrays 101', 102', a plurality of pixels, each of which includes a thin film transistor (also referred to as a TFT hereinafter) 201, a liquid crystal capacitance 203 and a capacitance component for holding an electric field applied to the liquid crystal capacitance 203 (holding capacitance) 202, are arranged two-dimensionally.

As has been explained in conjunction with the display element part of the display device of this embodiment, in the respective pixel arrays A, B (101', 102'), a plurality of scanning signal lines 205 which extend in parallel in the lateral direction (the first direction) of the display screen and are arranged in parallel in the longitudinal direction (the second direction which crosses the first direction) are provided. In this embodiment, m (m being an even number equal to or more than 2) scanning signal lines are arranged in the image display region of the display panel 100' shown in FIG. 10 and, as shown in FIG. 11, (m/2) of these scanning signal lines are provided to the pixel array A (101') which is in charge of the image display of the upper side of the screen of the display panel 100' and the remaining (m/2) scanning signal lines are provided to the pixel array B (102') which is in charge of the image display of the lower side of the screen of the display panel 100'. Accordingly, out of the scanning signal lines 205 ranging from the first scanning signal line which is positioned at an upper end of the image display region of the display panel 100' to the mth scanning signal line which is positioned at a lower end of the image display region, (m/2) scanning signal lines 205 which range from the first scanning signal line to the mth scanning signal line are arranged in parallel in the pixel array A (101') and the respective scanning signal lines 205 are sequentially given addresses ranging from AG(1) to AG(m/2) for identification. Further, the scanning signal lines 205 ranging from the (m/2+1)th scanning signal line to the mth scanning signal line at the lower end of the screen which are arranged in the lower half of the image display region of the display panel 100' are arranged in parallel in the pixel array B (102') and the respective scanning signal lines 205 are sequentially given addresses ranging from BG(m/2) to BG(1) for identification. Scanning signals (voltage signals) are applied to the scanning signal lines AG(1) to AG(m/2) of the pixel array A(101') from the scanning signal driver circuit A (103') shown in FIG. 10, while scanning signals (voltage signals) are applied to the scanning signal lines BG(m/2) to BG(1) of the pixel array B(102') from the scanning signal driver circuit B (104') shown in FIG. 10.

On the other hand, as has been explained in conjunction with the display element part of the display device of this embodiment, in respective pixel arrays A, B (101', 102'), a plurality of video signal lines 204 which extend in parallel in the longitudinal direction (the above-mentioned second direction) of the display screen and are arranged in parallel in the lateral direction (the above-mentioned first direction) are provided. In this embodiment, n (n being a natural number equal to or more than 2) video signal lines are arranged in the image display region of the display panel 100' shown in FIG. 10 and, as shown in FIG. 11, these video signal lines are individually provided to the pixel array A(101') and the pixel array B(102'). To n video signal lines 204 which are arranged in parallel in the pixel array A(101'), addresses ranging from AD(1) to AD(n) are sequentially given from a left end of the image display region of the display panel 100' shown in FIG. 10, while to n video signal lines 204 which are arranged in parallel in the pixel array B(102'), addresses ranging from BD(1) to BD(n) are also sequentially given from the left end of the image display region of the display panel 100' shown in FIG. 10. Both of the video signal line AD(x) (x being an arbitrary natural number which falls within a range of 1 to n) formed in the pixel array A and the video signal line BD(x) formed in the pixel array B function as the xth video signal lines from the left end of the image display region of the display panel. However, they are electrically separated from each other. Accordingly, it is possible to simultaneously apply voltages different from each other to the video signal line AD(x) and the video signal line BD(x). Out of the video signal lines AD(1) to AD(n) of the pixel array A(101'), although not shown in the drawing in this embodiment, the video signals are supplied to the video signal lines AD(1) to AD(n/2) from the video signal driver circuit A1(105') shown in FIG. 10, while the video signals are supplied to the video signal lines AD(n/2+1) to AD(n) from the video signal driver circuit A2(106') shown in FIG. 10. Further, out of the video signal lines BD(1) to BD(n) of the pixel array B(102'), although not shown in the drawing in this embodiment, the video signals are supplied to the video signal lines BD(1) to BD(n/2) from the video signal driver circuit B1(107') shown in FIG. 10, while the video signals are supplied to the video signal lines BD(n/2+1) to BD(n) from the video signal driver circuit B2(108') shown in FIG. 10.

In FIG. 11, with respect to the pixels which are provided two-dimensionally in the pixel arrays 101', 102', image signals which are supplied through the video signal lines 204 are received by drain regions of the above-mentioned thin film transistors 201 provided to the respective pixels, and selection voltages (voltage pulses which are also referred to as gate selection pulses, for example) are applied to gate electrodes of the thin film transistors 201 from the scanning signal lines 205 whereby voltages corresponding to the image signals are applied to the liquid crystal capacitances 203. Accordingly, with respect to groups of pixels which are respectively arranged in the pixel arrays 101', 102', n pixel columns are formed for every video signal line 204 which supplies the image signals to the group of pixels and, further, (m/2) pixel rows are formed for every scanning signal line 205 which is selected in response to the scanning signals. Accordingly, in the display panel 100' shown in FIG. 10, there is formed a so-called "an m×n matrix array" in which m pixel rows are arranged in parallel in the longitudinal direction (the above-mentioned second direction) and n pixel rows are arranged in the lateral direction (the above-mentioned first direction). Corresponding to these pixel rows and pixel columns, the liquid crystal capacitances 203 which are provided to the respective pixels are arranged two-dimensionally in plane on the display panel 100' and the in-plane optical transmissivity of the display panel 100' is determined to a given value for every pixel in response to voltages (image signals) applied to the respective liquid crystal capacitances 203.

The thin film transistors 201 are active elements which control the optical transmissivities which the liquid crystal capacitances 203 of the respective pixels (in other words, portions of the liquid crystal layer corresponding to respective pixels) exhibit. A diode or the like may be used in place of the thin film transistor 201 as such an active element depending on the display panel 100'. Since the active element is relevant to the selection of the pixel row, the active element is also referred to as a switching element. The thin film transistor 201 has the field effect transistor structure which controls the movement of charges through a channel formed between the source region and the drain region by applying an electric field to the channel from a gate. Accordingly, in the display device which arranges the pixels having the thin film transistors 201 two-dimensionally, the video signal line which supplies the pixel signal to the drain region is also referred to as a drain line, the video signal driver circuit which outputs the image signal to the video signal line is also referred to as a drain driver circuit, the scanning signal line which applies the scanning signal to the gate (gate electrode) is also referred to as a gate line, and the scanning signal driver circuit which outputs the scanning signal to the scanning signal line is also referred to as the gate driver circuit. Here, in FIG. 10, the video signal driver circuits 105', 106', 107', 108' are also referred to as the drain driver circuits A1, A2, B1, B2, while the scanning signal driver circuits 103', 104' are also referred to as gate driver circuits A,B.

With respect to the image signals, in the respective video signal driver circuits 105' to 108' shown in FIG. 10, based on the image data transferred to the video signal driver circuits 105' to 108', gray scale voltages corresponding to the display luminance of respective pixels are selected and outputted to the video signal lines corresponding to the respective pixels. To sides of the liquid crystal capacitances 203 shown in FIG. 11 opposite to the thin film transistors 203, a common line 206 is connected and a reference voltage with respect to the gray scale voltage applied to one ends of the liquid crystal capacitances 203 is applied to the other ends of the liquid crystal capacitances 203.

In this embodiment, the pixel arrays 101', 102' having the equivalent circuit shown in FIG. 11 are arranged within one liquid crystal layer provided to the display panel 100'. Although the equivalent circuit of the pixel array 101' and the equivalent circuit of the pixel array 102' are shown individually in FIG. 11, it is not necessary to divide the liquid crystal layer for respective pixel arrays based on such an arrangement of the equivalent circuits. To simplify the manufacturing steps of the display panel 100' and to ensure the quality of the displayed image on the display panel, it is recommendable that two groups of electrodes and wiring are formed corresponding to respective equivalent circuits of the pixel arrays 101', 102' within one liquid crystal display panel. In this embodiment, unless otherwise specified, the display panel 100' described hereinafter is formed as one liquid crystal display panel on which the respective equivalent circuits of the pixel arrays 101', 102' are formed.

Here, the equivalent circuit shown in FIG. 11 is, provided that the liquid crystal display device is a liquid crystal display device which has field effect transistors as active elements, applicable irrespective of a switching mode such as an IPS (In Plane Switching) mode, a TN (Twisted Nematic) mode, an MVA (Multi-domain Vertical Arrangement) mode or an OCB (Optical Compensation Birefringence) mode. Further, in the thin film transistor 201 shown in FIG. 11, the channel layer may be formed of any one of a-Si (amorphous silicon), p-Si (polycrystalline silicon) or pseudo signal crystals of silicon.

FIG. 12 is a timing chart showing the image display timing over two continuous frame periods in the liquid crystal display device having the above-mentioned constitution and corresponds to FIG. 6. With respect to a case shown in FIG. 12, the advance of writing of video data to the pixel array and the advance of writing of the blanking data are indicated by data which are shown for every line.

Then, since the screen of the display panel 100 is constituted of the pixel array A (the upper-side pixel array) and the pixel array B (lower-side pixel array) which can perform writing respectively independently, the liquid crystal display device to which this embodiment is applied is configured to simultaneously perform the writing of video data and the writing of the blanking data at a certain point of time.

Figure 12A:
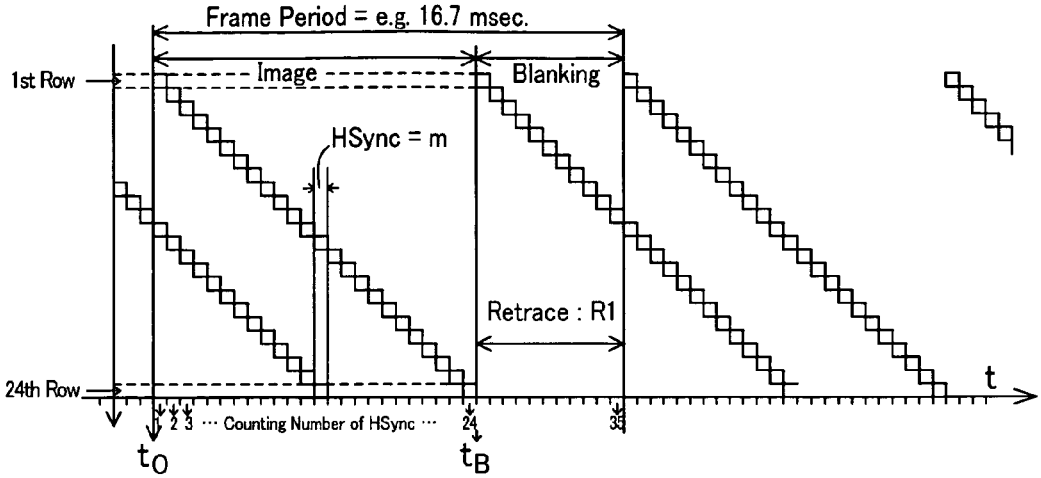
FIGS. 12A, 12B and 12C are timing charts showing image display timing in the display device shown in FIG. 10 over two successive frame periods.

That is, in FIG. 12A, in a case in which the video data is not yet changed and the adjustment between the display period for video data and the display period for blanking data is properly performed, first of all, at the beginning of the each frame period, writing of the video data from the first scanning line (1 st row) at the pixel array A side to the pixel array is started in response to the first pulse of the scanning start signal FLM (not shown in the drawing). Here, the pulses of the horizontal synchronizing signal HSYNC corresponding to a time (Δt1 shown in FIG. 6) for preset next writing of the blanking data are counted. Further, at a point of time that writing of the video data from the first scanning line (1 st row) to the pixel array is performed, writing of the blanking data to certain lines in the pixel array B side is successively performed following the preceding frame period.

The number of the pulses of the horizontal synchronizing signal HSYNC corresponding to a time (Δt1 shown in FIG. 6) from writing of the video data into the pixel array starting from the first scanning line (1st Row) to preset next writing of the blanking data is, for example, set to 24 for convenience's sake in FIG. 12A and writing of the video data is sequentially performed up to the 24th scanning line (24th Row). Then, at a next point of time in which the count value of the pulses of the horizontal synchronizing signal HSYNC becomes 24, writing of the blanking data is started. Then, writing of the blanking data continues as it is, during the frame period, such that the number of pulses of the horizontal synchronizing signal HSYNC reaches a value 35 (a value set for convenience's sake of explanation) from the above-mentioned value 24.

In the image display timing shown in FIG. 12A, the ratio between the display period for video data and the display period for blanking data is set to 24: (35−24), wherein approximately 35% of one frame period is allocated to the display period for blanking data.

Figure 12B:
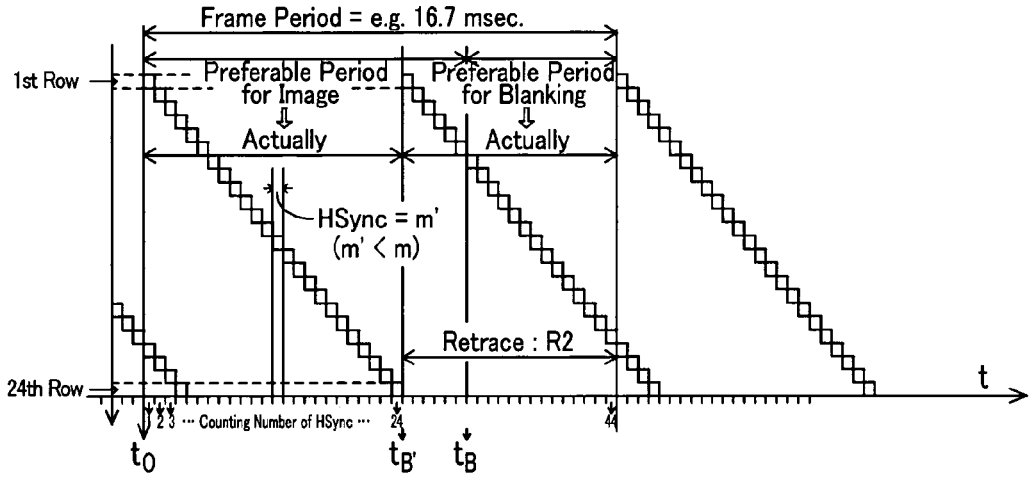

FIG. 12B shows a case in which the input video data is changed and the cycle of the horizontal synchronizing signal HSYNC contained in the video data is made shorter than the horizontal synchronizing signal HSYNC in the case shown in FIG. 12A. In the same manner, at the beginning of the frame period, the writing of the video data to the pixel array from the first scanning line (1st Row) at the pixel array A side continues until the count number (24) of the pulses of the horizontal synchronizing signal HSYNC corresponding to the time (Δt1 shown in FIG. 6) until writing of the next blanking data. Then, from a next point of time which succeeds the above time, writing of the blanking data is started. This writing of the blanking data continues, during the frame period, such that the number of pulses of the horizontal synchronizing signal HSYNC reaches a value 44 (a value set for convenience's sake of explanation) from the above-mentioned value 24. Accordingly, the ratio between the display period for video data and the display period for blanking data becomes 24: (44−24), and, hence, the display period for blanking data in one frame period is increased.

In this embodiment, in view of these drawbacks, even when the cycle of the horizontal synchronizing signal HSYNC of the video data is changed, the starting time for writing the blanking data is properly determined so as to hold the ratio between the display period for video data and the display period for blanking data to the set value.

That is, the number of pulses of the horizontal synchronizing signal HSYNC during one frame period of the input video data is measured, and a value obtained by subtracting a value which is obtained by multiplying the measured number to the ratio of the display period of the blanking data per preset one frame period from the measured number is used as the number of pulses of the horizontal synchronizing signal HSYNC from writing of the video data to writing of the blanking data. This value is a value which corresponds to the time Δt1 shown in FIG. 6.

Figure 12C:
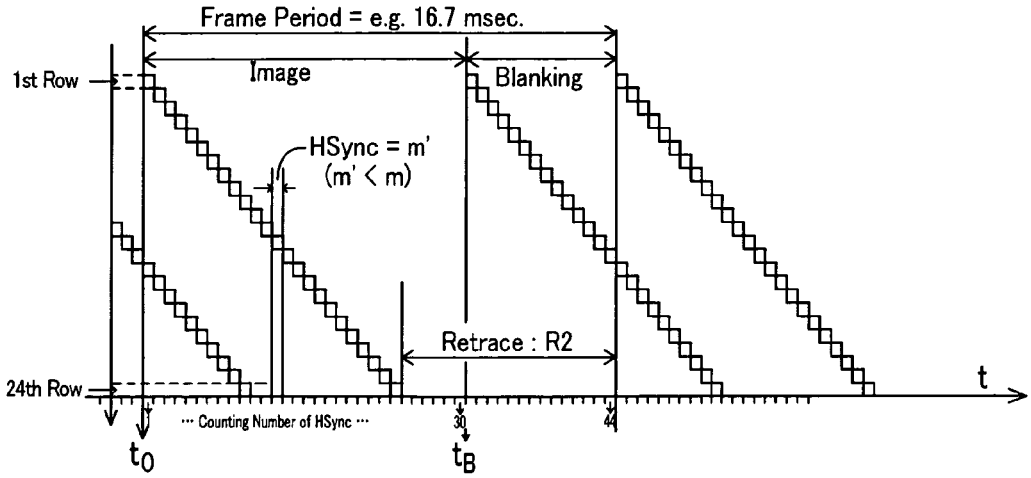

FIG. 12C also shows a timing chart of the image display timing which shows a case in which the horizontal synchronizing signal HSYC is inputted while having a cycle similar to the cycle of the case shown in FIG. 12B. The number of pulses during one frame period of the horizontal synchronizing signal HSYC is 44 in the same manner as the case shown in FIG. 12B.

Further, the ratio of the blanking data per one preset frame period is (35−24)/35 as indicated in conjunction with the case shown in FIG. 12A.

From the above, the following formula (1) is obtained. This value is the number of pulses of the horizontal synchronizing signal HSYNC from writing of the video data to writing of the blanking data and becomes 30.

$$44-44\times\{(35-24)/35\} \quad \ldots (1)$$

In this manner, by performing writing of the blanking data after a point of time in which the number of pulses of the horizontal synchronizing signal HSYNC assumes 30 from writing of the video data, it is possible to hold the ratio of the display period for the blanking data per one frame period unchanged even when the cycle of the horizontal synchronizing signal HSYNC is changed.

As described above, the means which computes the starting point of writing of the blanking data based on the number of pulses of the horizontal synchronizing signal HSYNC per one frame period and the ratio of the display period of the blanking data per preset one frame period may be constituted of an electronic circuit and this electronic circuit may be formed such that the electronic circuit is incorporated in the above-mentioned display control circuit 104.

Here, in the above-mentioned embodiment, although the starting point of writing of the blanking data is computed based on the ratio of the display period of the blanking data per preset one frame period, it is needless to say that the starting point of writing of the blanking data is not always limited to such a value and may be computed based on the ratio of display period of the video data per preset one frame period.

Fourth Embodiment

In the display device described in connection with the third embodiment, the screen of the display panel 100' is constituted of the pixel array A (the upper-side pixel array) and the pixel array B(the lower-side pixel array) which can perform writing of data independently from each other.

Figure 13A:
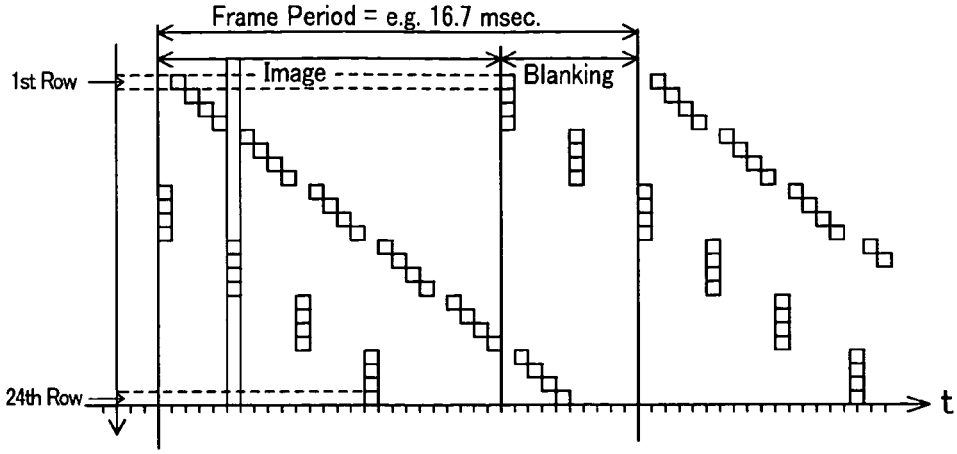
FIGS. 13A, 13B and 13C are timing charts showing image display timing in the display device shown in FIG. 3 over two successive frame periods.
Figure 13B:
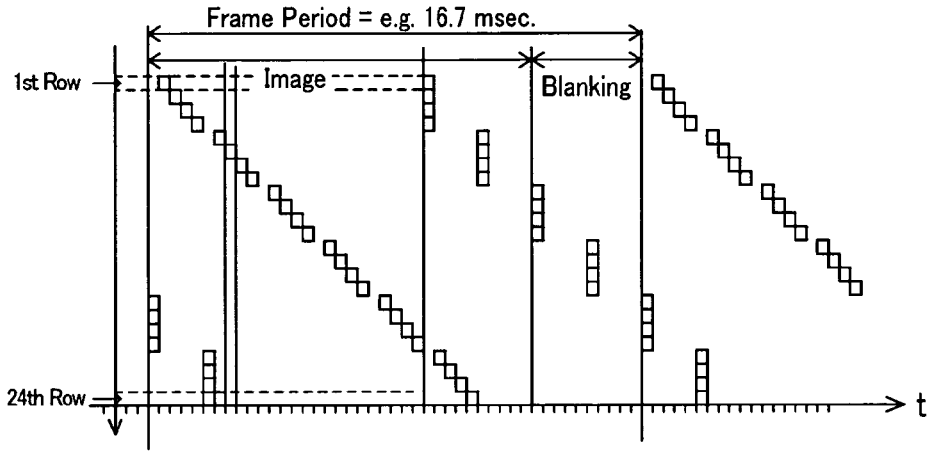
Figure 13C:
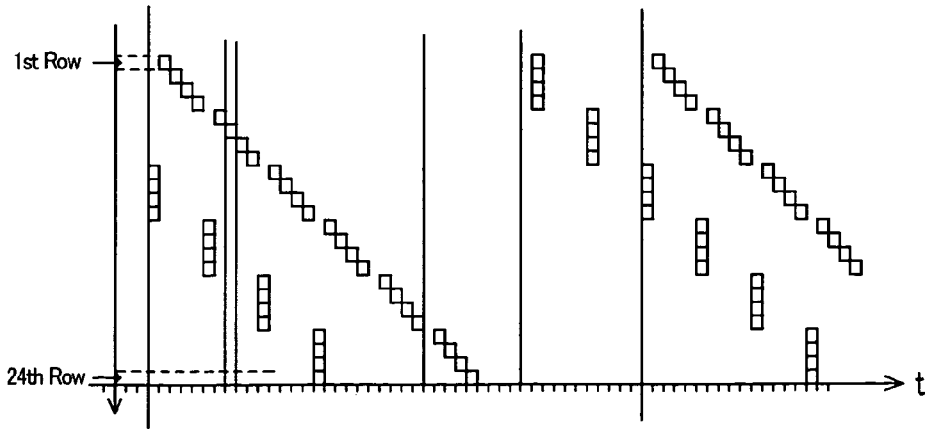

However, it is needless to say that even when such a constitution is not adopted, for example, even for the display device shown in the first embodiment, the constitution shown in the third embodiment is applicable. FIG. 13A, FIG. 13B and FIG. 13C are timing charts of image display timings when the above-mentioned constitution is applied to such a display device, and they respectively correspond to FIG. 12A, FIG. 12B and FIG. 12C.

The display device described in connection with the first embodiment is configured such that the line number of the gate lines selected during one horizontal period in writing of the blanking data is a plural number (for example, 4) and writing of the video data is not performed during the period. A portion which makes the timing charts shown in FIG. 13A, B, C different from the timing charts shown in FIG. 12A, B, C is only such a portion and there exists no difference with respect to other portions.

The above-mentioned respective embodiments may be used in a single form or in combination. This is because the advantageous effects of the respective embodiments may be obtained in a single form or in a synergistic manner.

As can be clearly understood from the foregoing explanation, according to the display device of the present invention, even when the video data is changed, it is possible to eliminate the possibility that the ratio between the display period for the display signals and the display period for the blanking data differs from the preset ratio.

What is claimed is:

1. A display device comprising a pixel array in which a plurality of pixel rows each of which includes a plurality of pixels arranged in parallel along the first direction are arranged in parallel along the second direction which intersects the first direction, a scanning driver circuit which selects the plurality of respective pixel rows in response to a scanning signal, a data driver circuit which supplies a display signal to the respective pixels included in at least one row selected in response to the scanning signal out of the plurality of pixel rows, and a display control circuit which controls a display operation of the pixel array, wherein lines of video data are inputted to the data driver circuit one after another for every horizontal scanning period of the video data, the data driver circuit alternately repeats (i) a first step for generating a display signal corresponding to each one of the lines of the video data one after another for every fixed period and outputting the display signal to the pixel array N-times (N being a natural number equal to or greater than 2) and (ii) a second step for generating a display signal which makes the luminance of the pixels lower than the luminance of the pixel in the first step for the fixed period and outputting the display signal to the pixel array M-times (M being a natural number smaller than N), the scanning driver circuit alternately repeats (i) a first selection step for selecting the plurality of pixel rows for every Y rows (Y being a natural number smaller than the N/M) sequentially from one end to another end of the pixel array along the second direction in the first step and (ii) a second selection step for selecting the plurality of pixel rows other than the pixel rows (Y×N) selected in the first selection step for every Z rows (Z being a natural number not smaller than N/M) sequentially from one end to another end of the pixel array along the second direction in the second step, and the display device further includes a means which sets a ratio of display in the second step per one frame period, and a means which measures the number of pulses of a horizontal synchronizing signal in one frame period contained in the video data, and determines a point of time for starting display in the second step in response to pulses of the horizontal synchronizing signal corresponding to the ratio based on a measured value of the number of pulses.

2. A display device comprising a pixel array in which a plurality of pixel rows each of which includes a plurality of pixels arranged in parallel along the first direction are arranged in parallel along the second direction which intersects the first direction, a scanning driver circuit which selects the plurality of respective pixel rows in response to a scanning signal, a data driver circuit which supplies a display signal to the respective pixels included in at least one row selected in response to the scanning signal out of the plurality of pixel rows, and a display control circuit which controls a display operation of the pixel array, wherein lines of video data are inputted to the data driver circuit one after another for every horizontal scanning period of the video data, the data driver circuit alternately repeats (i) a first step for generating a display signal corresponding to each one of the lines of the video data one after another for every fixed period and outputting the display signal to the pixel array N-times (N being a natural number equal to or greater than 2) and (ii) a second step for generating a display signal which makes the luminance of the pixels lower than the luminance of the pixel in the first step for the fixed period and outputting the display signal to the pixel array M-times (M being a natural number smaller than N), the scanning driver circuit alternately repeats (i) a first selection step for selecting the plurality of pixel rows for every Y rows (Y being a natural number smaller than the N/M) sequentially from one end to another end of the pixel array along the second direction in the first step and (ii) a second selection step for selecting the plurality of pixel rows other than the pixel rows (Y×N) selected in the first selection step for every Z rows (Z being a natural number not smaller than N/M) sequentially from one end to another end of the pixel array along the second direction in the second step, and the display device further includes a means which sets a ratio of display in the first step per one frame period, and a means which measures the number of pulses of a horizontal synchronizing signal in one frame period contained in the video data, and determines a point of time for starting display in the second step in response to pulses of the horizontal synchronizing signal corresponding to the ratio based on a measured value of the number of pulses.

3. A display device according to claim 2, wherein the number of rows: Y of the pixel rows which are selected in the first selection step in response to a single output of the display signal in the first step is 1, the number of outputs: N of the display signal in the first step is 4 or more, the number of rows: Z of the pixel rows which are selected in the second selection step in response to a single output of the display signal in the second step is 4 or more, and the number of outputs: M of the display signal in the second step is 1.

4. A display device comprising a pixel array which has a plurality of pixels arranged in row direction and the column direction, a scanning driver circuit and a data driver circuit which are connected to the pixel array, and a display control circuit which is connected to the scanning driver circuit and the data driver circuit, and is configured such that the pixel array is divided by an imaginary line which extends along the first direction as a boundary and respective divided arrays are independently operated in response to the scanning drive circuit and the data driver circuit, wherein lines of video data are inputted to the data driver circuit one after another for every horizontal scanning period of the video data, the data driver circuit alternately repeats (i) a first step for generating a display signal corresponding to each one of the lines of the video data one after another for every fixed period and outputting the display signal to one pixel array out of the pixel arrays at least a single time and (ii) a second step for generating a display signal which makes the luminance of the pixels lower than the luminance of the pixel in the first step for the fixed period and outputting the display signal to another pixel array out of the pixel arrays at least a single time, the scanning driver circuit alternately repeats (i) a first selection step for selecting the plurality of pixel rows for at least every 1 line sequentially from one end to another end of one pixel array along the second direction in the first step and (ii) a second selection step for selecting the plurality of pixel rows for at least every 1 line sequentially from one end to another end of another pixel array along the second direction in the second step, and the display device further includes a means which sets a ratio of display in the second step per one frame period, and a means which measures the number of pulses of a horizontal synchronizing signal in one frame period contained in the video data, and determines a point of time for starting display in the second step in response to pulses of the horizontal synchronizing signal corresponding to the ratio based on a measured value of the number of pulses.

5. A display device according to claim 4, wherein a means which measures the number of pulses of horizontal synchronizing signals for one frame period contained in the video data and determines a point of time for starting display in the second step in response to pulses of the horizontal synchronizing signals corresponding to the ratio based on the measured value is incorporated into the display control circuit.

6. A display device comprising a pixel array which has a plurality of pixels arranged in the row direction and the column direction, a scanning driver circuit and a data driver circuit which are connected to the pixel array, and a display control circuit which is connected to the scanning driver circuit and the data driver circuit, wherein the data driver circuit alternately repeats (i) a first step for outputting a display signal to the pixel array N-times (N being a natural number equal to or greater than 2) and (ii) a second step for outputting a display signal which corresponds to luminance equal to or less than luminance corresponding to the display signal M-times (M being a natural number smaller than N), the scanning driver circuit alternately repeats (i) a first selection step for selecting every Y rows of the pixel array in the first step and (ii) a second selection step for selecting the Z rows other than the rows selected in the first selection step in the second step, and the display device further includes a means which measures the number of pulses of a horizontal synchronizing signal in one frame period contained in the video data inputted to the display control circuit, and determines a point of time for starting display in the second step based on a measured value of the number of pulses.

7. A display device according to claim 6, wherein the display device includes a circuit for setting a ratio of operation between the first step and the second step per one frame period.

8. A display device according to claim 6, wherein the display device includes a circuit for setting a ratio of display of the first step per one frame period.

* * * * *